United States Patent [19]

Codding

[11] Patent Number: 4,878,582

[45] Date of Patent: Nov. 7, 1989

[54] MULTI-CHANNEL BICHROMATIC PRODUCT SORTER

[75] Inventor: Elias H. Codding, Houston, Tex.

[73] Assignee: Delta Technology Corporation, Houston, Tex.

[21] Appl. No.: 171,560

[22] Filed: Mar. 22, 1988

[51] Int. Cl.[4] ..... B07C 5/342

[52] U.S. Cl. ..... 209/580; 209/582; 250/226; 356/407

[58] Field of Search ..... 209/580–582; 250/226, 223 R; 356/407

[56] References Cited

U.S. PATENT DOCUMENTS

| | | | |
|---|---|---|---|
| 3,410,402 | 11/1968 | Gundrum et al. | 209/922 |
| 4,170,306 | 10/1979 | Marshall et al. | 209/582 |
| 4,239,118 | 12/1980 | Lockett | 209/582 |
| 4,330,062 | 5/1982 | Conway et al. | 209/582 |
| 4,379,636 | 4/1983 | Yoshida | 209/582 |
| 4,454,029 | 6/1984 | Codding | 209/587 |
| 4,513,868 | 4/1985 | Culling et al. | 209/581 |
| 4,626,677 | 12/1986 | Prowne | 209/580 |

FOREIGN PATENT DOCUMENTS

| | | | |
|---|---|---|---|
| 2133535 | 7/1984 | United Kingdom | 209/581 |

*Primary Examiner*—Joseph J. Rolla
*Assistant Examiner*—Steve Reiss
*Attorney, Agent, or Firm*—Pravel, Gambrell, Hewitt, Kimball & Krieger

[57] ABSTRACT

A bichromatic product sorter is disclosed which uses both pattern checking and ratio checking of reflected light, indicating the color of the product, to determine the acceptability of the product. The ratio checking compares the two color components with each other against a dark background. The sorter can perform pattern checking, ratio checking, or a combination of both on the product. A number of individual channels are combined on the sorter to reduce the space and electronics required to provide a given throughput. The electronics are multiplexed to reduce the required number of components. The viewing chambers are shaped to allow improved space utilization in the classification area, reducing the total amount of space required for multiple channel operation.

22 Claims, 16 Drawing Sheets

| OPERATION \ SIGNAL | AUTO GAIN | AUTO NULL |
|---|---|---|
| AUTO NULL (GATE 410) | 0 | 1 |
| AUTO GAIN (GATE 412) | 1 | 0 |
| SORTING | 0 | 0 |

MULTI-CHANNEL BICHROMATIC PRODUCT SORTER

BACKGROUND OF INVENTION

1. Field of the Invention:

The present invention relates to optical sorting machines for agricultural products.

2. Description of the Prior Art:

U.S. Pat. No. 4,454,029, of which applicant is the inventor, related to a bichromatic sorter for agricultural products. These sorters were based upon a pattern checking technique wherein portions of the descending agricultural product, such as coffee beans or peanuts, were inspected for unsatisfactory coloration. The unsatisfactory coloration that was detected was in the form of light or dark spots on the product, indicating a bad product. Upon sensing these undesirable spots, the sorter then rejected the undesirable product by causing it to fall into a different location from the desirable product. This technique of pattern checking allowed spots and other light or dark imperfections to be detected, but did not solve the problem of product having uniformly undesirable coloration, indicating, for example, overripeness or immaturity of the product. Further, while pattern sorting permitted color sorting, it was done at reduced accuracy when compared to ratiometric sorting.

Prior art sorters have been constructed as single units which are then assembled into groups of multiple independent units to allow higher volume operation. This technique of multiple independent units increased the space requirements according to the number of sorting units required, since in effect a chosen number of sorting units were arranged in parallel as if they were individual units. Further, it unduly increased the amount of electronic circuitry, because the scanning and control functions were repeated in each sorting unit. The unnecessarily large space requirements and increased electronics for multiple channel sorting did not afford any significant cost saving or efficiency for added sorting channels, since each added channel in effect added the cost of another sorting machine for that channel.

SUMMARY OF THE INVENTION

Briefly, the present invention provides a new and improved sorter for agricultural product for sorting the product into acceptable and unacceptable categories based on the color characteristics of individual scanned ones of the product. The sorting is done both ratiometrically to detect unsatisfactory color of the product and by pattern checking to detect unsatisfactory light or dark product.

The product to be sorted is received in a number of parallel hoppers and passes individually through a chute or tube past a zone of illumination in a viewing chamber. In the viewing chamber, light reflected from the passing product is optically divided into at least two different color illumination level components, which are converted into color component signals. The color component signals are then processed and subjected to both ratiometric and pattern check electronic color comparisons. The ratiometric color component comparison is performed to determine if the product has a uniformly undesirable coloration, indicating, for example, overripeness or immaturity of the product. The pattern check color comparison is performed to detect undesirably light or dark spots or other defects on the product. The pattern checking comparison is performed against measurements taken from an active, illuminated color background in the viewing chamber, while the ratiometric checking comparison is performed against a black, or no color background in the same viewing chamber at substantially the same time. If either comparison is negative, the viewed product is indicated to be unacceptable. Unacceptable product is ejected to separate it from acceptable product.

The apparatus includes at least two individual viewing chambers in a single apparatus, producing a multichannel sorting apparatus. The configuration of the various components of the viewing chambers is configured to allow interlocking or interconnection of the viewing chambers to reduce the space requirements necessary for multiple channels of operation.

The incorporation of several different viewing chambers or product channels into a single unit reduces space requirements. Further, electronic circuitry provided with the present invention allows the reduction of the number of electronic elements required for multiple channel operation by multiplexing the various received optical signals for processing by a single product classifying circuit. Multiplexing of the sorting function of each of the several viewing chambers in a single classification section reduces the number of components and thereby the cost and complexity of a multiple channel apparatus.

The present invention also provides automatic correction of the levels of the background color component signals used in pattern check sorting and also of the intensity of illumination by fluorescent illuminating lamps in the viewing chamber used to provide overall illumination of the product for sorting.

DESCRIPTION OF THE PREFERRED EMBODIMENT

Figure 1:
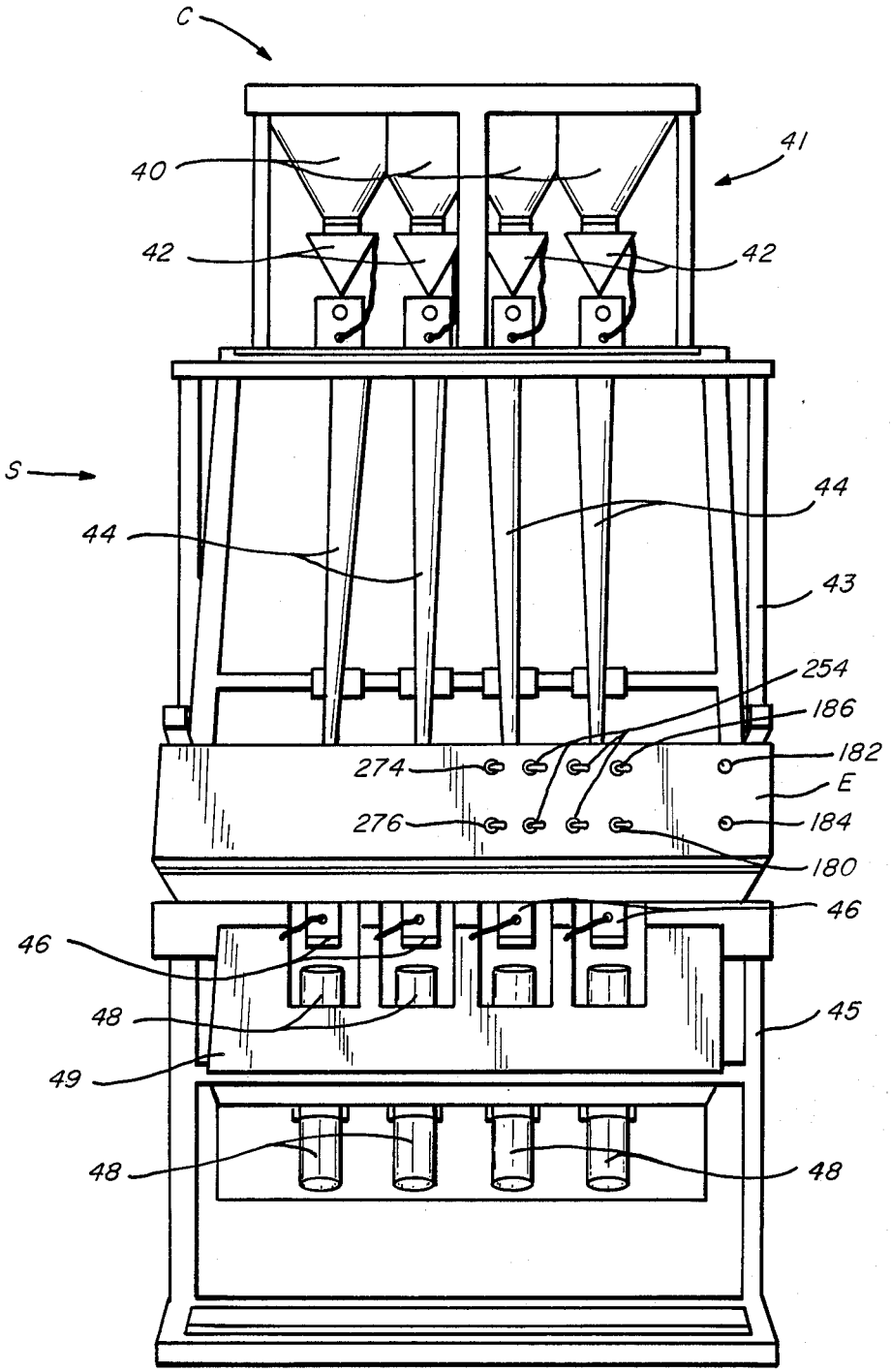
FIG. 1 is a front view of a multi-channel sorter according to the present invention.

In the drawings, the letter S (FIG. 1) designates generally a sorting machine according to the present invention for sorting agricultural products into acceptable and unacceptable categories based on the color characteristics of the products. The agricultural products may be, for example, coffee beans, other types of beans, peas, or peanuts as well as other fruit and vegetables or other products.

Figure 2:
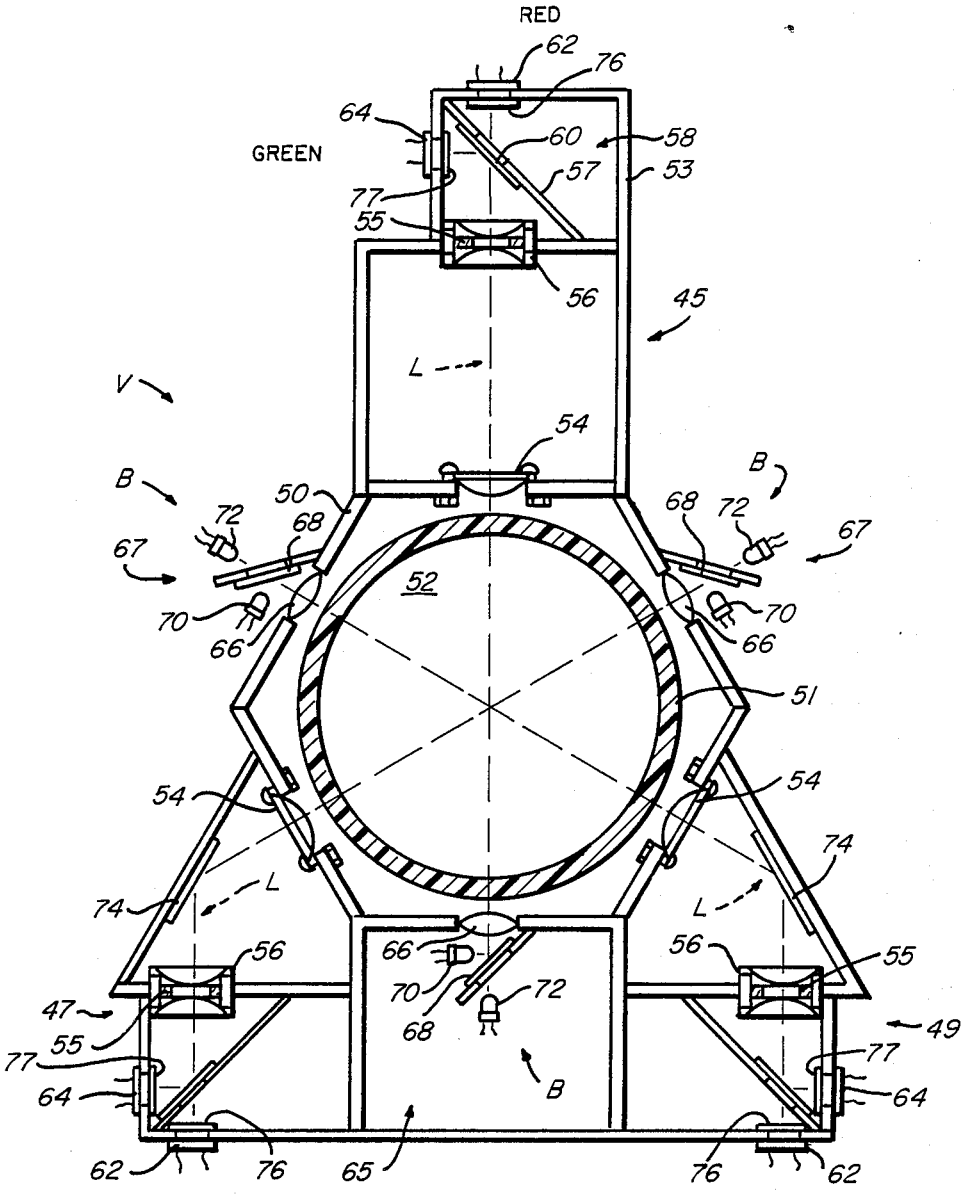
FIG. 2 is a top view of one viewing chamber of the sorter of FIG. 1.
Figure 3:
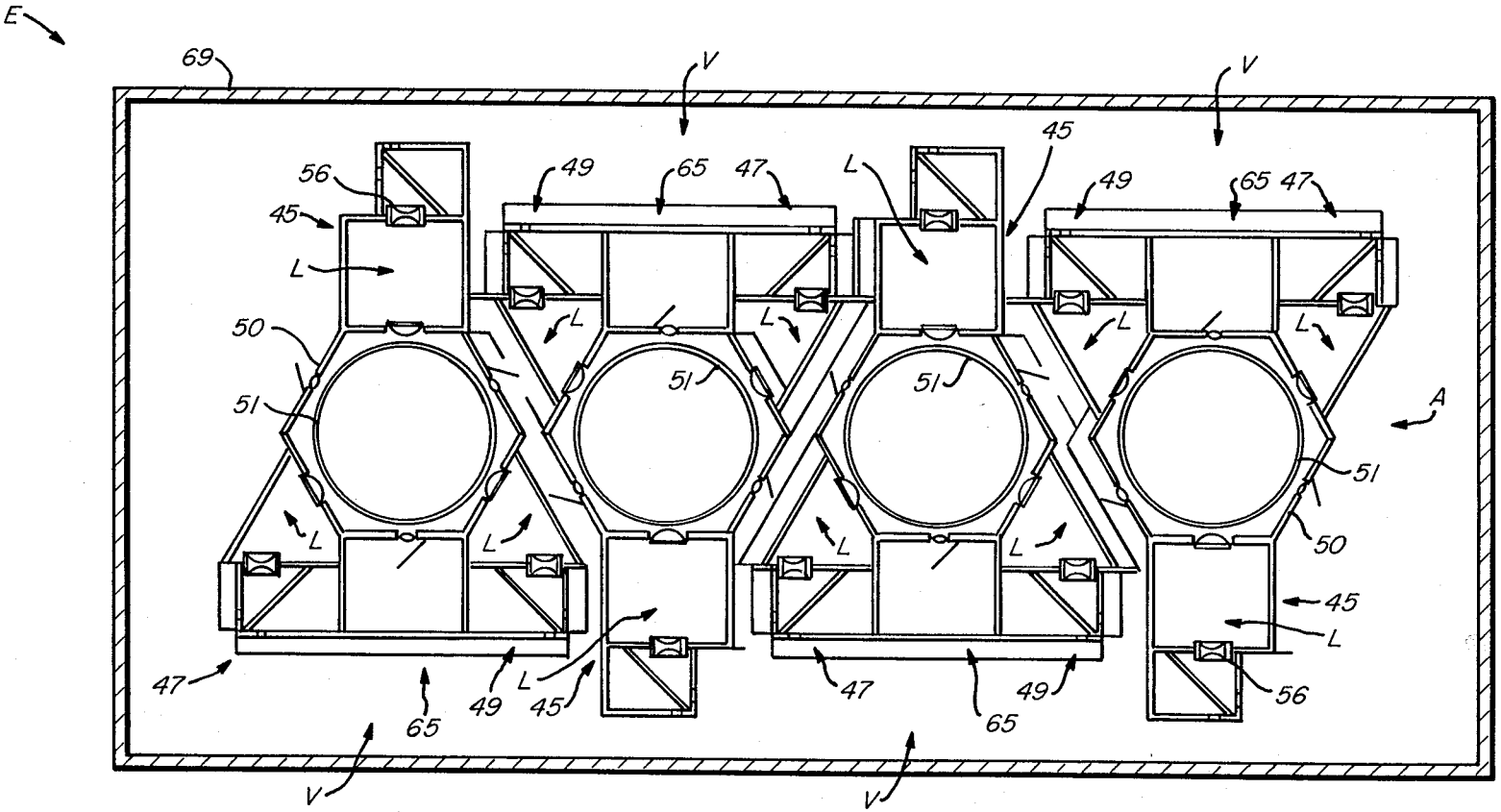
FIG. 3 is a top view of multiple viewing chambers according to FIG. 2 mounted together in the sorter of FIG. 1.

The sorter S has a number of product passages or channels C in a single sorting unit. The product to be sorted in each product channel C is received in a hopper 40 mounted on an upper frame portion 41 of the sorter S. The product moves under the influence of a vibratory feeder 42 from the hopper 40 in a stream of individual ones of the product which fall into a chute or conduit 44 mounted on an intermediate frame portion 43 of sorter S. The individual ones of the product in each product channel descend under the influence of gravity through each conduit 44 into a separate associated viewing chamber V (FIG. 2) illuminated by a suitable number of fluorescent lamps. The plural viewing chambers V and the fluorescent lamps are contained in an electronics housing E (FIGS. 1 and 3) mounted on a lower frame portion 45 of the sorter S.

Optical measurements are made of the descending product in each of the viewing chambers V. Two types of optical measurements are made. The first is a ratiometric measurement for a ratiometric sort, of the relative presence of components of two colors reflected from the scanned product, taken in the absence of any color background illumination. According to the present invention, and as used throughout the present application, this condition shall be referred to as black background, since the only light present is the ambient fluorescent light coming from the fluorescent lamps into the viewing station V to illuminate the product being scanned.

The second optical measurement is taken virtually simultaneously and thus is substantially of the same portion of the product on which the first measurement is taken. The second measurement is of the pattern type and involves the relative reflectivity, against an illuminated background, of each of the same two component colors. The color background illumination levels are emitted into the viewing chamber V by color light sources while the second optical measurement is being taken.

Figure 4:
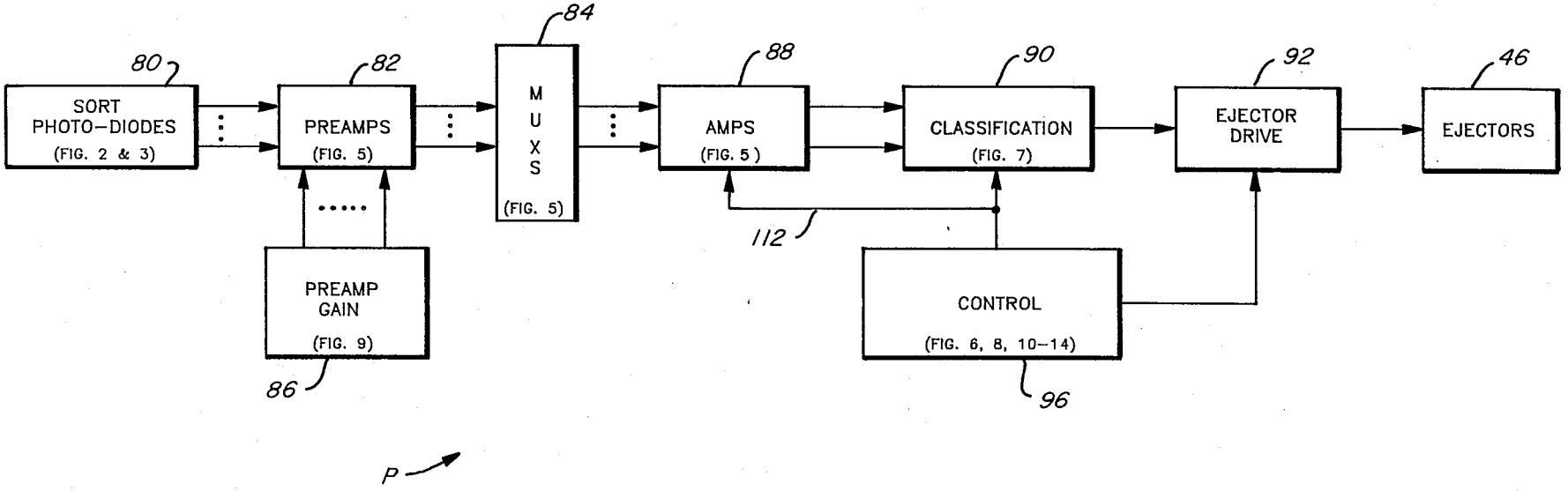
FIG. 4 is a functional block diagram of the electronic processing circuitry of the sorter of FIG. 1.

Both optical measurements for each of the viewing stations V are converted into electrical signals which are indicative of the measurements made of the product in viewing chamber V. The electrical signals are scanned in a multiplexed fashion by an electronic processing circuit P (FIG. 4). The electronic processing circuit P is contained on a suitable number of printed circuit boards mounted in the electronics housing E (FIG. 1).

In the processing circuit P, both ratiometric and pattern check color comparisons are made to determine if the product is acceptable. In the event that either type of color comparison, or both, detects unacceptable product, an ejector 46 for that channel C is activated. The ejector 46 is typically pneumatic and is mounted beneath the electronics housing E so that it may separate the detected unacceptable product. Activation is timed to allow the unacceptable product to fall from the viewing station V down into the vicinity of ejector 46. The acceptable product is, however, allowed to fall past the ejector 46 through a tube 48, mounted on a lower hopper 49 extending outwardly from the lower frame 45 of the sorter S, into a suitable container. The unacceptable product, however, falls in a different path due to the action of the ejector 46 into a separate container.

Each viewing chamber V has a central, generally hexagonal, housing assembly 50 (FIG. 2) containing a transparent cylindrical tube 51 surrounding a central circular opening 52 serving as a product viewing area through which the product falls. The opening 52 of viewing chamber V is illuminated by the fluorescent lamps in pairs above and below an array A of viewing stations V (FIG. 3) mounted in the electronics housing E.

The viewing chamber V (FIG. 2) has three receiving lens mounting chambers 45, 47, and 49, each containing a receiving lens system L, and one background source chamber 65 containing a background source B. Two other background sources B are mounted externally of the viewing chamber V. Each receiving lens system L is located diametrically opposite a background source B to directly receive light emitted from such background source. The three receiving lens systems L are spaced equidistant about the periphery of the cylindrical tube 51 and central opening 52 to detect reflected light from the entire surface of any product descending through the viewing chamber V.

The lens mounting chamber 45 is generally rectangular in cross-section, having a receiving lens 54 mounted in an opening of an inner wall thereof. A secondary lens arrangement 56 is mounted at an outer wall of the lens mounting chamber 45. The side walls of the lens mounting chamber 45 are of a length determined by the requirements for suitable focusing onto a focusing or framing slit in a plate 55 of the secondary lens arrangement 56.

Each of the lens mounting chambers 47 and 49 are generally triangular in cross-section, having a receiving lens 54 mounted in an opening in an inner wall thereof and a secondary lens and framing arrangement 56 mounted in another side wall. A reflective mirror 74 is mounted on the third side wall of each of the lens mounting chambers 47 and 49 to reflect the light received by the receiving lens 54 onto to the secondary lens arrangement 56.

The reflective mirrors 74 permit the lens mounting chambers 47 and 49 to assume a general triangular configuration, permitting the viewing chambers V to have a general Y-shaped configuration in cross-section, allowing the viewing chambers V to be arranged with the lens mounting chambers 45 at opposite positions (FIG. 3) from each other. This permits the viewing chambers V to be mounted between two thin cover plates in the staggered interlocked arrangement of an array A, forming an assembly which can be easily inserted in the housing E. This affords a material reduction in the lateral width of the electronics housing than that offered by prior art multiple channel sorters with three views.

A generally rectangular sensor chamber 53 is formed outwardly of each of the lens mounting chambers 45, 47 and 49 in the viewing chamber V to mount a sensing photodiode arrangement 58. A dichroic mirror 60 is mounted on a transversely extending wall 57 of the sensor housing 53 to split the light incident thereon from the focusing lens arrangement 56 into a light color pair of two different colors. Light of a first color passes through the dichroic mirror 60 in the opening in the wall 57 and is focused onto a sensing photodiode 62 mounted in an outward wall of the sensor housing 53. Light of a second color is reflected from the dichroic mirror 60 onto a sensor photodiode arrangement 64 mounted in a side wall of the sensor housing 53.

In the preferred embodiment, the two colors used for sorting are green and red, although other colors may be used. A first photodiode 62 receives the red light passed by the dichroic mirror 60 and red filter 76 and a second photodiode 64 receives the green light reflected by the dichroic mirror 60 and passed by green filter 77. Signals from the photodiodes 62 and 64 are then transmitted to electronic processing circuitry P (FIG. 4).

Each of the background sources B (FIG. 2) produces background light which is used to provide a background reference against which the color of the product can be measured in pattern check sorting to detect the presence of undesirable light or dark areas on the product. Each background source B includes a pair of background light emitting diodes (LED) 70 and 72 for channels 1 and 2 and 74, 76 for channels 3 and 4. Background LED 70 emits green light when energized, while background LED 72 emits red light to match the colors split by the dichroic mirror 60 in the sensor housing 53. A dichroic mirror 68 is provided to combine the two colors of light emitted by the LED's 70 and 72 into a single beam of light. This light is collimated by a lens 66, one of which is mounted in an opening in an inner wall of a rectangular background source chamber 65, and the other two of which are mounted in side walls of the housing assembly 50. The light collimated by lens 66 enters the product viewing area and serves as a color background reference which is then transmitted across the chamber V to the corresponding main lens 54.

In the processing circuitry P (FIG. 4), electrical color level signal pairs for the first and second colors indicating the respective light levels are produced by the pair of sensing photodiodes 62 and 64 for each of the receiving lens systems L of each of the viewing stations V, functionally designated as sort photodiodes 80. These electrical signals are furnished in parallel to a preamplifier section 82 for signal processing. The preamplifier section 82 contains a single preamplifier and associated circuitry for each photodiode. The gain of the preamplifiers is adjusted to compensate for optical and electronic variations by manual gain control circuitry 86. This is an adjustment made during initial set up of the sorter S. The color level signals in parallel from the preamplifiers 82 are then multiplexed by a multiplexer unit 84 and furnished to automatic gain and null control amplifier circuitry 88. The amplifier circuitry 88 compensates the color level signals individually for light level variations in the particular viewing chamber V, electronic drift and the like. The gain and null adjusted color level signals are then furnished to classification circuity 90.

Classification circuitry 90 analyses the color level signals by performing both a pattern check sort and a ratiometric sort. If the product is unacceptable based on either sort or both, the classification circuitry 90 produces a signal which is transmitted to ejector drive circuitry 92 which enables the ejector 46 associated with the viewing station V where the unacceptable product was detected. The enabled ejector 46 then separates the unacceptable product from the acceptable products. Control circuitry 96 is provided to control the operating cycles of the remainder of processing circuity P.

Figure 5:
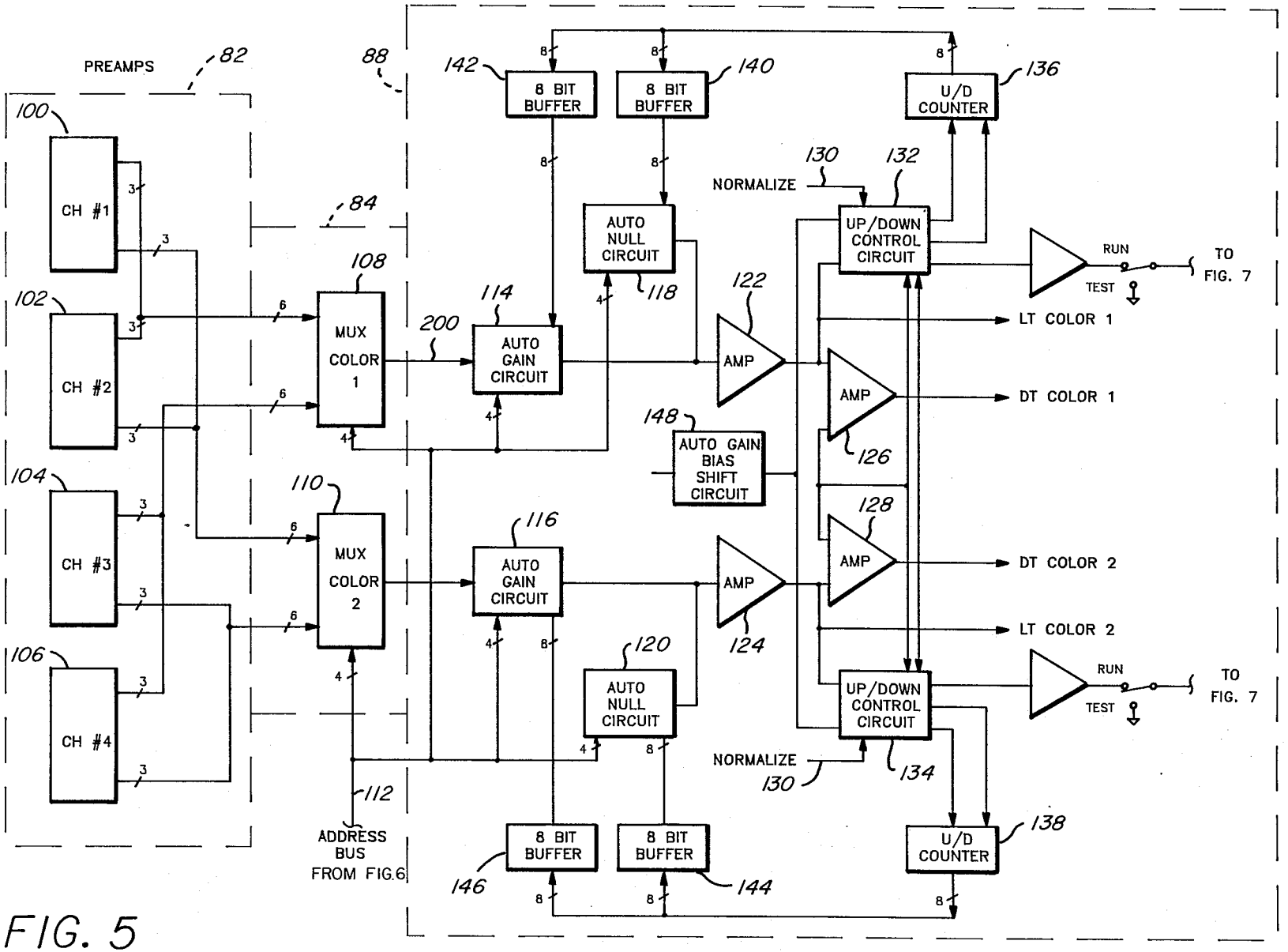
FIGS. 5, 6, 7, 8, 9, 10, 11, 12, 13, and 14 are schematic electrical circuit diagrams of portions of the circuit of the electronic circuitry of FIG. 4.

In the preamplifier circuitry 82 (FIG. 5), a preamplifier is provided for each photodiode 62 and 64, so that each viewing chamber V has six preamplifiers associated with it, three for each color. The six preamplifier outputs from the first channel 100 are separated into color groups, with the amplified outputs of red photodiodes 62 transmitted to a first multiplexer 108. The amplified outputs of green photodiodes 64 are transmitted to a second multiplexer 110. Similarly, the color level signal pairs from the other viewing stations are furnished to preamplifiers 102, 104 and 106. After amplification, the color level signals are separated so that all of the first or red color level signals are presented to multiplexer 108 and all of the second or green color level signals pass to multiplexer 110. By use of the multiplexers 108 and 110 the number of analog amplification and classification circuits is materially reduced over the prior art. Amplification circuit 88 and classification circuit 90 on a time division multiplex basis perform both pattern check and ratiometric sorting for all lens systems of all viewing stations.

In the amplification circuitry 88 (FIG. 5), signals on an address bus 112 from control circuit 96 (FIG. 6) determine which particular color signal pair from a particular viewing chamber V is being processed by amplification circuitry 88. The selected color signal pair passes through the multiplexers 108 and 110 to automatic gain circuits 114 and 116. Automatic gain circuits 114 and 116 periodically adjust the level of each individual color signal furnished by the illuminated background, with no product in view, to a uniform output magnitude.

Automatic null circuits 118 and 120 periodically provide a bias shift or adjustment to the individual null signals furnished by the dark backgrounds with no product in view. The periodic gain and null adjustments are necessary to counteract any slow dust accumulation over the viewing tubes, changes in primary illumination, and to a somewhat lesser extent, electronic drift. The outputs of the automatic gain circuit 114 and the automatic null circuit 118 are combined in an operational amplifier 122 to produce a light trip, or LT color 1, signal for the first color representative of the intensity of the light sensed from the particular photodiode 62. Similarly, the output of the automatic gain circuit 116 and the automatic null circuit 120 are combined in an operational amplifier 124 to produce a light trip output signal, or LT Color 2 signal representative of the intensity of the light detected by the particular photodiode 64.

Figure 7:
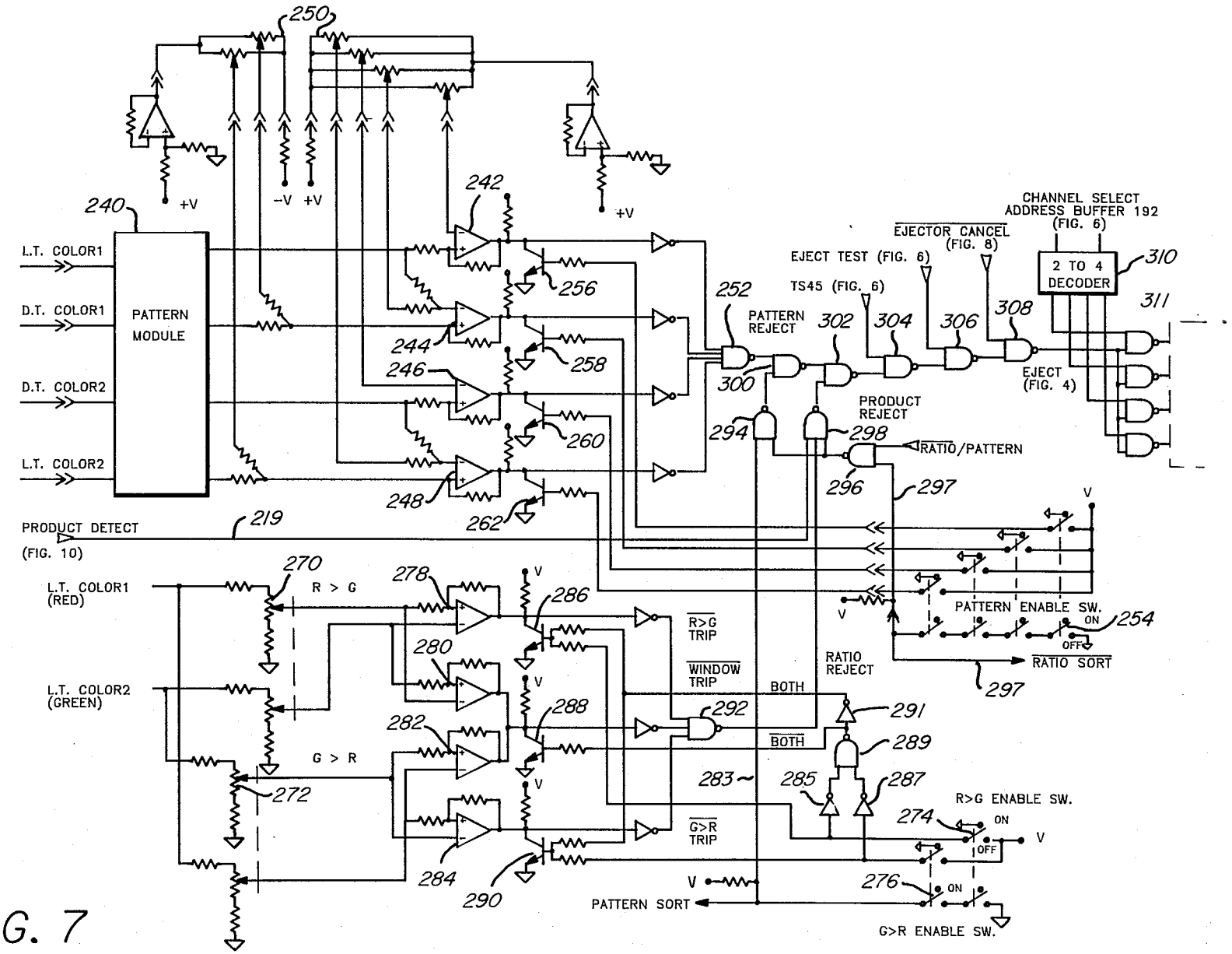

The light trip signal for the first color from the amplifier 122 is inverted in an amplifier 126 to produce a dark trip signal, DT Color 1, for the first color, or red. Similarly, the light trip signal, LT Color 2, for the second color, or green, is provided to an inverting amplifier 128 to form a dark trip or DT signal for the second color. The LT signals and the DT signals for each of the two colors are furnished to the classification circuit (FIG. 7).

Periodically during sorting operations, product feeding is stopped and the amplification circuitry 88 goes into a normalization mode, in response to the control circuit 96 on receipt of a NORMALIZE signal on conductor 130, either automatically or on command of the sorter operator.

In the normalization mode, the color sensing signals from photodiode pairs 62 and 64 for each of the receiving lens systems L of each viewing chamber V are adjusted sequentially until all signals from sorting photodiodes 80 have been set at the appropriate level settings.

Specifically, in the normalization mode, appropriate level settings for the automatic gain circuits 114 and 116, as well as the automatic null circuits 118 and 120 are established. In the auto gain mode, up/down control circuit 132 and 134 receive and compare background color level reference signals sensed by the photodiodes 62 and 64 from the background source B associated therewith. The particular background color reference signal pair is furnished through the amplifiers 122 and 124 to up/down control circuits 132 and 134, respectively. An auto gain bias shift circuit 148 provides a reference level signal of +600 mV to each of the up/- down control circuits 132 and 134 so that a comparison of the sensed background level sensors from the background source B can be made with the level established by the auto gain circuit 148.

Up/down counter circuits 136 and 138 are connected to the control circuits 132 and 134 and are incremented to count upwardly or downwardly based on the comparison results obtained from the control circuits 132 and 134. The counting process continues until the outputs of amplifiers 122 and 124 are within ±15 mV of the level from the gain bias shift circuit, indicating the gain settings are appropriate for the photodiode pair being monitored. These last counts are the only counts left stored in circuits 114 and 116, respectively. Buffers 142 and 146 act as transmission gates directing the outputs of counters 136 and 138 into auto gain circuits 114 and 116, respectively.

In a like manner, during the normalization mode, the setting for the auto null circuits 118 and 120 is established. This is accomplished by furnishing the outputs of auto null circuits 118 and 120 to the inverting inputs of amplifiers 122 and 124 in the absence of color level reference signals. At this time, the outputs of amplifiers 122 and 124 are presented to the up/down control circuits 132 and 134 and a comparison again performed with a bias level signal, now zero mV furnished by the auto gain/bias shift circuit 148. If the setting of either of the auto null circuits 118 and 120 varies from the established bias level furnished by the circuit 148, the associated up/down counter 136 or 138, as the case may be, is incremented until the amplified outputs from 122 and 124 matche the null bias level set by the circuit 148. Again the last counts are the only counts left stored, for the photodiode pair being monitored. This time the storage occurs in circuits 118 and 120 and buffers 140 and 144 connect counter 136 to auto null circuit 118 and counter 138 to auto null circuit 120, respectively.

A master counter 158 (FIG. 6) in the control circuit 96 provides timing signals to control the operating cycles of the sorters, including the multiplex scanning sequence of the color level signal pairs to be processed by the amplification circuitry 88. A voltage controlled oscillator 160 provides basic system clock frequency pulses to drive the master counter 158. The oscillator 160 has a first, higher operating frequency during sorting operations and a second, lower operating frequency during normalization periods.

Figure 8:
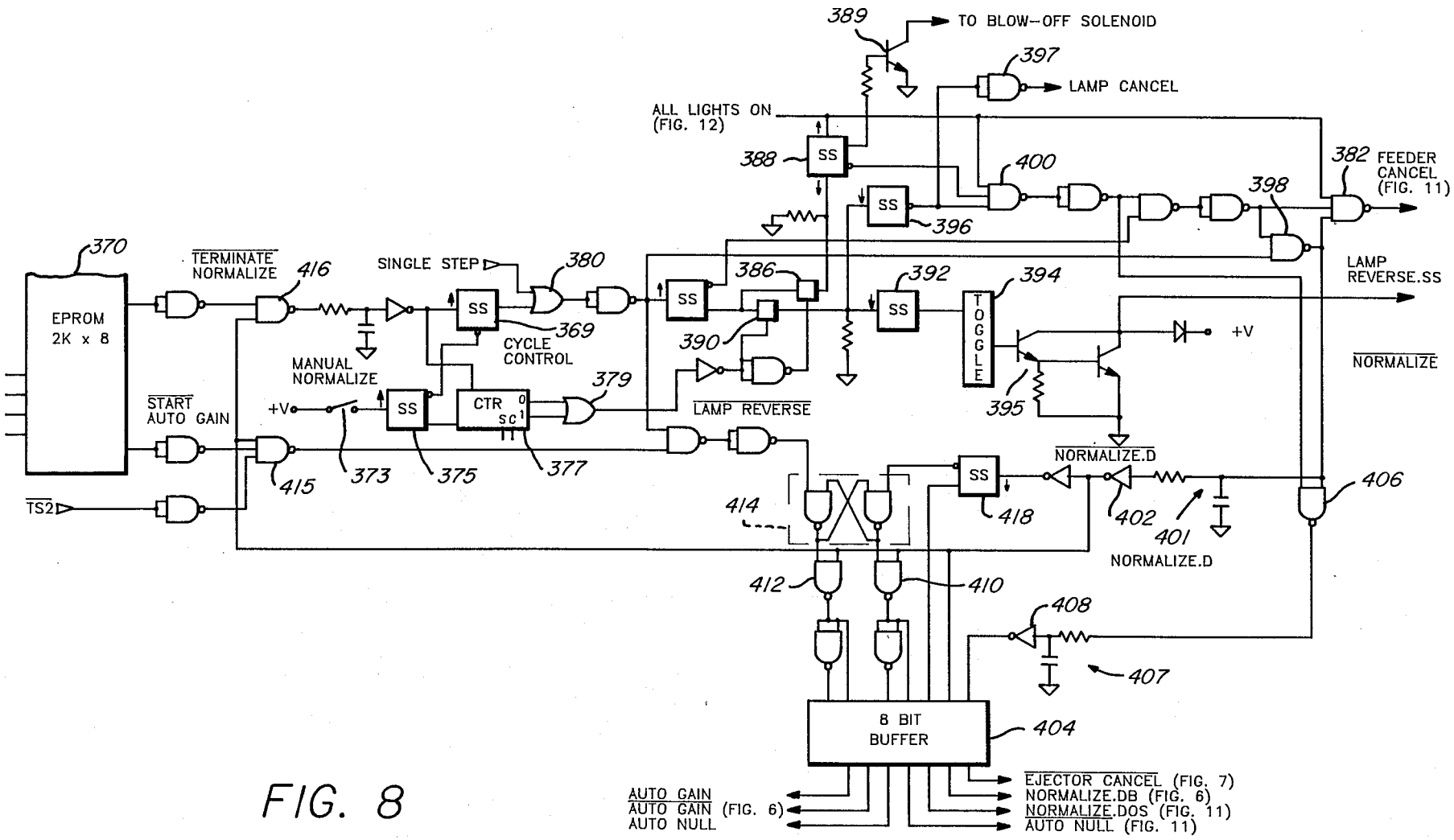
Figure 9:
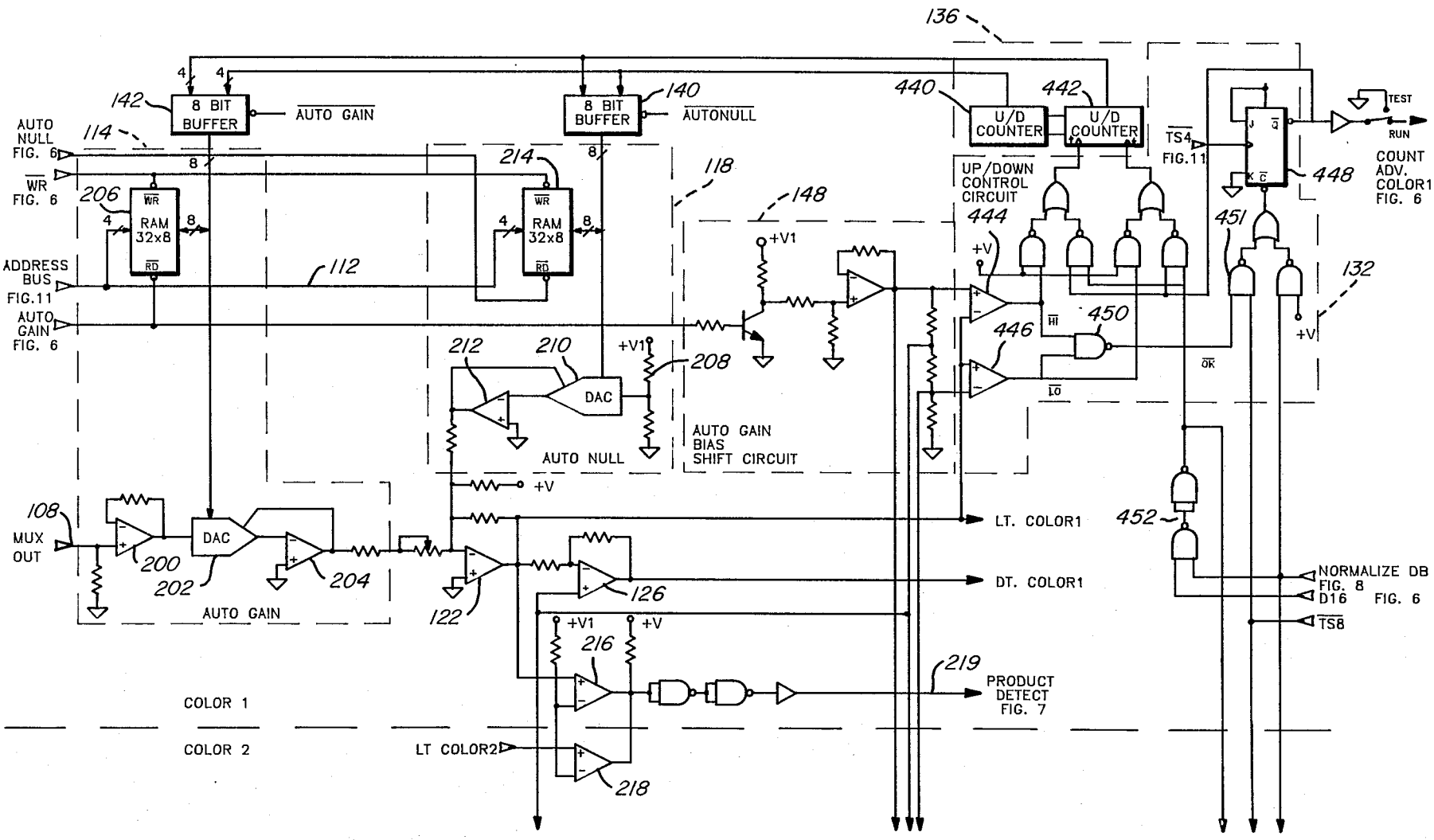

Output pulses from the oscillator 160 clock a four bit counter 162 used to provide subinterval timing references for circuitry in the processing circuit P. The three most significant bits of the counter 162 are transferred through a buffer 164 to a digital three-to-eight channel decoder circuit 166. Decoder 166 provides timing signals or control pulses on selected ones of its eight outputs depending upon the the three digital input bits from buffer 164. Control pulses related to the frequency of oscillator 160 appear in sequence on the eight output terminals of decoder 166, based on the digital count presented decoder 166 by buffer 164. However, only certain of these timing signals are used. For example, the timing sigals on output terminals 1, 3 and 7 of decoder 166 are not used. The timing signals from decoder 166 actually used, their identification, and their destinations in the control circuit 96 are set forth in the following chart:

| TIME SLOT(S) | IDENTIFICATION | DESTINATION |
|---|---|---|
| 2 | $\overline{TS2}$ | FIG. 8 |
| 4 | $\overline{TS4}$ | FIG. 9 |
| 4 and 5 | $\overline{TS45}$ | FIG. 7 |
| 6 | $\overline{WR}$ | FIG. 9 |
| 8 | $\overline{TS8}$ | FIG. 9 |

The carry output from counter 162 is inverted by a gate 168 (FIG. 7) and connected to a first input of a three input NAND gate 170 and to a fourth input of the buffer 164 to provide a further subinterval timing reference, as will be set forth. The other two inputs of NAND gate 170 are normally held high during sorting operations by the output of NAND gates 172 and 174, so that the output of NAND gate 170 furnishes clock pulses to the master counter 158.

The master counter 158 is comprised of two 4-bit counters 171 and 173 combined to form an eight bit counter, of which six bits are used. The two least significant bits are presented as two of the four bits on address bus 112 to control which of the three pairs of photodiodes 62 and 64 in a particular viewing chamber V are presented by multiplexer 84 to amplifier circuit 88. View two is sampled twice to utilize all four time slots addressed by the two least significant bits of counter 171. The next two most significant bits of counter 171 are presented as the other two bits on address bus 112 to control which of the four viewing chambers V is having its photodiode pairs presented in sequence by multiplexer 84 to amplifier circuit 88. The next most significant bit controls alternation between ratiometric and pattern check sorting during the sorting cycle. Finally, the most significant bit of counter 173 is furnished to other portions of the control circuit 96, as will be set forth. The six bits used in the counter 158 are connected to a first input channel of a series of electronic switches 176, 178, and 180, which function as selector switches.

The second input channels to the switches 176, 178 and 180 are connected to user selectable switches 182 and 184 and to ground, respectively. Ejector test switch 186, and single step switch 188 are also mounted on the electronics housing E. Closing of either switch has the result of causing the multiplex system to continuously select the view and channel indicated by front panel rotary switches 182 and 184, respectively. The switch 188 enables single step station testing. Single step testing permits the operator to concentrate on the operation of only one particular view of one particular channel and monitor the corresponding signals with a test instrument, such as an oscilloscope, on front panel test jacks. Also a signal is sent to control circuitry 96, the purpose of which will be described later. In ejector test operations, when indicated by switch 186, oscillator 190 is activated and directed to one of the ejectors according to the number on channel switch 184. This selection is accomplished by decoder 310 (FIG. 7). Unless either ejector test switch 186 or single step switch 188 is closed, master counter 158 controls the sorting sequence.

In the autogain circuit 114, (FIG. 9) the output of multiplexer 108 is received by a buffer operational amplifier 200 configured in a noninverting arrangement. The output of the amplifier 200 is transmitted to a multiplying digital/analog converter 202 and its associated output operational amplifier 204. The multiplying digital/analog converter 202 is used to provide a digitally controlled gain, allowing each red-sensing photodiode of the sensors to have an adjustable individual assigned gain value used for automatic gain purposes. This allows adjustment of gain levels to compensate for variation in individual lighting and dust accumulation among the sensors. The individual gain values for the automatic gain settings are stored in a random access memory 206. The appropriate memory location for the particular view and channel is selected by a signal code signal on the address bus 112. The autogain circuit for the second color contains like components to circuit 114 and functions in a like manner. The output of the operational amplifier 204 is connected to the inverting input of the operational amplifier 122, which operates as a summing device, as has been set forth.

The automatic null circuit 118 of amplifier circuit 88 includes a voltage divider network 208 connected to a multiplying digital/analog converter 210 and its associated operational amplifier 212. Also connected to the multiplying digital/analog converter 210 is a random access memory 214. The memory 214 contains the individual null bias values for each red sensing photodiode of the sorter S, allowing a proper null bias to the multiplexer 108 output signal to produce a uniformly biased signal for classification. The auto null circuit 120 for the second color contains like components to circuit 118 and functions in a like manner.

Thus, it can be seen the automatic gain circuits of the amplifier circuit 118 correct and compensate for individual gain and null variations due to dust accumulation, light variation and aging of optical or electronic components. This feature and multiplexing permit only a single classification circuit to classify the product of all channels as it passes through the sorter S.

The output of amplifier 122 is also provided to a non-inverting input of a comparator 216 used to determine whether a product has passed through the viewing chamber V. This feature only comes into play during ratiometric type classification, to prevent comparisons of inaccurate low signal levels. The negative terminal of the comparator 216 is connected to a reference voltage. The LT signal of the other color is connected to the non-inverting input of a comparator 218, with the same reference voltage as that of comparator 216 being applied to the negative or inverting input of comparator 218. The common connection of the output of 216 and 218 is equivalent to an "and" condition requiring the simultaneous detection of product in both colors before a high logic level product detect signal is produced on conductor 219. The role of this in ratiometric classification will be described below.

The DT and LT signals for both colors are communicated to a pattern module 240 (FIG. 7) in the classification circuit 90. The pattern module 240 is conventional and constructed to function according to techniques well known to those skilled in the art. The outputs of the pattern module 240 are furnished to a bank of comparator amplifiers 242, 244, 246 and 248 used in the pattern check sort to determine if the color level signals indicate unacceptable product. Sensitivity of the pattern circuitry is set by bias circuitry 250. A high level output signal from any of the pattern comparators 242, 244, 246 and 248 indicates that an unacceptable product, or pattern rejection, is present. The presence of a pattern rejection is indicated by a high signal on the output of a four input NAND gate 252, which combines the output signals from the pattern comparators 242, 244, 246 and 248.

Selection of the various pattern criteria is enabled by opening or closing pattern enable switches 254 (FIG. 7) mounted on the electronics housing E. When a pattern enable switch for a particular comparator is off, a high level signal is transmitted to the base of a clamping transistors 256, 258, 260 and 262, each of which is associated with a particular comparator. Each clamping transistor forces the output of its associated pattern comparator low so that no pattern rejection signal can be produced by that particular comparator. If all of the pattern trip or enable switches 254 are off, the pattern check sorting of sorters is disabled.

Turning off all the pattern classification switches 254 also causes a ground to he present on line 297 (FIG. 7). This is effected by the series connection of all of the ganged second sections of the pattern switches 254 to ground. This causes the output of gate 296 to be continuously high, preparing gate 298 for the ratio classification high out of gate 292 and the product detect on line 219. The output of gate 252 is low in the event all pattern trips switches 254 are off, causing the output of a gate 300 to be high, thus enabling gate 302 to pass a ratio reject signal should it occur.

In a similar way, a ground level is on line 283 only when both ratio switches 274 and 276 are off, preparing the classifier section for continuous pattern classification since now the outputs of both NAND gates 294 and 298 are continuously high.

If at least one of ratio classification switches 274 and 276 and one of pattern switches 254 is on, then the classification alternates on command by the fifth bit in the master counter 158 (FIG. 6), which is furnished as an input to NAND gate 296 (FIG. 7). When this command is low, a gate 298 is prepared for ratio classification and the output of gate 294 is low. Thus, pattern classification is blocked and the output of gate 300 is high, preparing gate 302 to pass a ratio classification signal. Alternatively, when this command is high, the outputs of gates 294 and 298 are high, preparing the system for pattern classification signals if they should occur.

The light trip, or LT signals for both colors are also transmitted to ganged potentiometer pairs 270 and 272, allowing a red color level greater than green (R>G) or green color level greater than red (G>R) ratio comparison to be made. The ratiometric color comparisons are made by a bank of comparator amplifiers 278, 280, 282 and 284. Comparators 278 and 280 make the R>G color comparison, while comparators 282 and 284 make the G>R color comparison. Comparator 278 forms a high level output signal in the event that an R>G comparison indicates an unacceptable red to green ratio is present in the product in the viewing chamber V. Similarly, comparator amplifier 284 forms a high level output signal in the event that a G>R comparison has detected an unacceptable green to red ratio of the product in the viewing chamber V.

The comparator amplifier 280 has the connection to its positive and negative inputs reversed from that of comparator amplifier 278, while comparator amplifier 282 has its positive and negative inputs reversed from those of comparator amplifier 284. In certain situations, a product is unacceptable if both the red to green and green to red color comparison ratios fall within an unacceptable color limit or window. The comparison settings on the potentiometers 270 and 272 are set in this situation to define the color window limits for red to green and green to red. Comparator amplifiers 280 and 282 form a high level signal indicating that the red to green and the green to red ratio results are within the unacceptable color window. Conversely, unless the color comparison signals are within the inverted R>G limits set by potentiometer 270 and the inverted G>R limits set by potentiometer 272, comparator amplifiers 280 and 282, when enabled, form no output signal.

Control of the particular type of ratiometric color comparison performed in comparison circuit 90 is controlled by the setting of the enable switches 274 and 276. When one of the enable switches 274 or 276 is depressed, the particular ratiometric color comparison designated by that switch is performed. When both of the switches 274 and 276 are depressed, a ratiometric color comparison is performed to determine whether the color ratio of the product being sorted falls within the unacceptable range or window of color ratios somewhere between the established inverted R>G and the established inverted G>R color ratios.

Comparator amplifier 278 which performs the R>G comparison is enabled by moving enable switch 274 to the ON position, placing a ground at the base of enabling transistor 286, disabling transistor 286 and allowing unsatisfactory color comparison signals detected by comparator amplifier 278 to pass through a NAND gate 292 as a RATIO REJECT signal.

G>R color comparisons are performed when enable switch 276 is switched on, placing an electrical ground on the base of transistor 290, inhibiting such transistor and allowing G>R color flaws detected by comparator amplifier 284 to pass through NAND gate 292.

When both enable switches 274 and 276 are switched on, the outputs of inverters 285 and 287 are driven high, causing the output of a NAND gate 289 to be low, grounding the base of a transistor 288 and indicating that window sorting is to be performed by the comparator amplifiers 280 and 282. If an unacceptable color which is within the established window limits is present, a RATIO REJECT signal is passed through NAND gate 292. If window sorting is desired, an inverter 291 forms a high level signal which is applied to the base of clamp transistors 286 and 290, grounding the outputs of comparator amplifiers 278 and 284.

When both enable switches 274 and 276 are off, clamping transistors 286, 288 and 290 are activated, grounding the output of comparator amplifiers 278, 280, 282 and 284 and forcing a low signal level from the ratio reject NAND gate 292 and therefore a high level from NAND gate 298.

Figure 6:
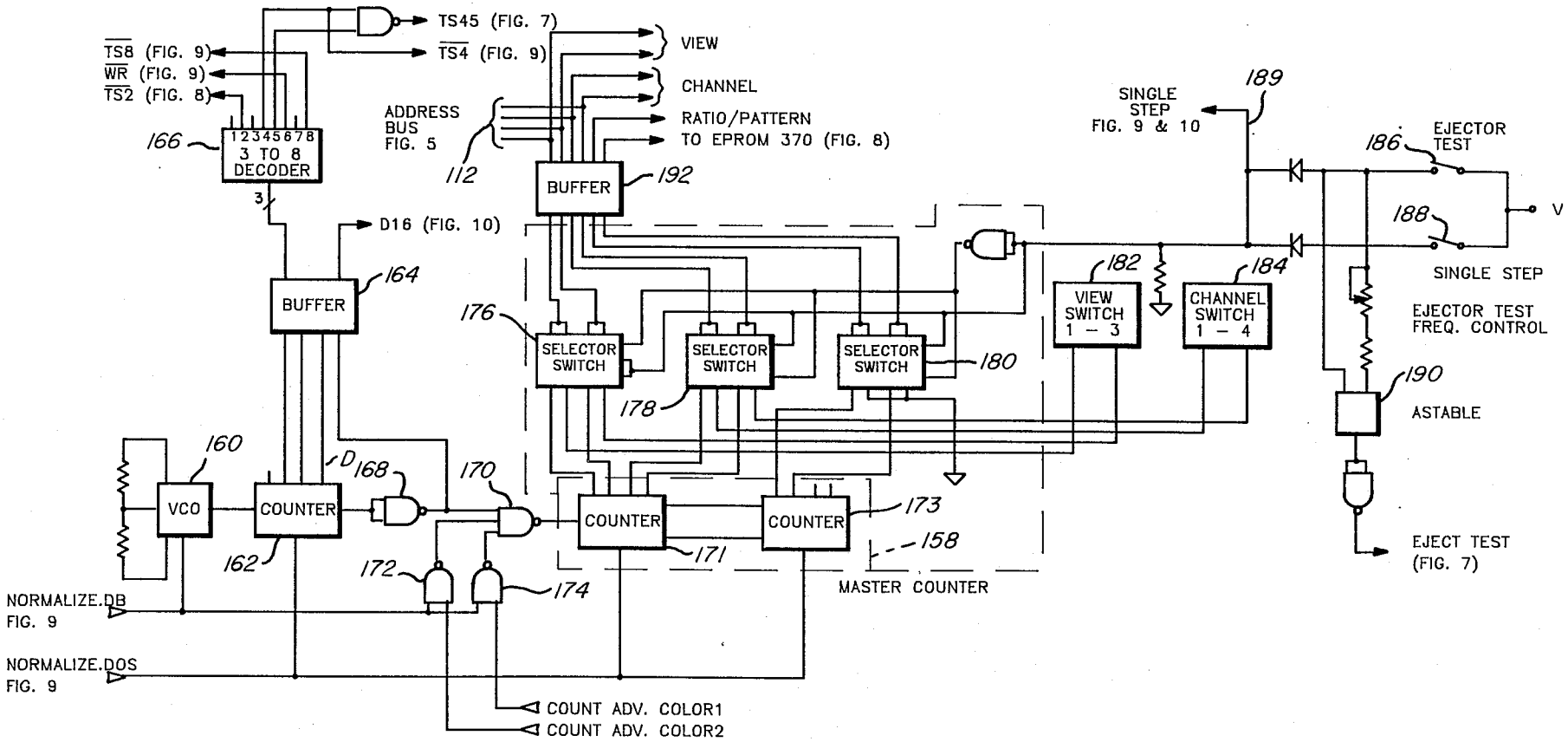

It is thus possible to perform either pattern checking, ratio checking, or both, on the product. If both ratio and pattern checking are done on a product, the comparisons are done alternatively on a multiplex basis at the rate of a RATIO/PATTERN signal which is the fifth bit of the master counter 158 (FIG. 6). The output frequency of the oscillator 160 is such that one cycle of the sixteen views analyzed takes approximately two-hundred microseconds, in which time the product moves only a very slight amount, thus allowing the ratio and pattern checks to be performed on substantially essentially the same positions on the product. The circuitry details of this mode of operation were explained previously in the present application.

The PRODUCT REJECT signal is furnished as one positive input to NAND gate 304 while the second positive input to NAND gate 304 is timing signal TS45 from decoder 166 (FIG. 6) to provide a time interval when the pattern sort circuits and ratio sort circuits are in effect scanned to see if unacceptable product is detected. The time interval so produced is used to allow time for the various signals to stabilize before any PRODUCT REJECT signal is deemed acceptable. The output of NAND gate 304 is combined in a NAND gate 306 with the EJECTOR TEST signal (FIG. 6). Under product sorting conditions, ejector testing is not occurring, the EJECTOR TEST signal is in high state, and a NAND gate 306 simply inverts the signal of NAND gate 304. The output of NAND gate 306 is combined with an $\overline{\text{EJECTOR CANCEL}}$ signal (FIG. 9) in a NAND gate 308. The $\overline{\text{EJECTOR CANCEL}}$ signal indicates that the ejectors 46 are inactive, either due to a normalization cycle or feeders 42 being disabled. The output of NAND gate 308 is an $\overline{\text{EJECT}}$ signal. The $\overline{\text{EJECT}}$ signal is furnished to ejector drive circuit 92 through decoding NOR gates 311 which drives ejectors 46 in the manner of U.S. Pat. No. 4,454,029 which is incorporated by reference herein.

Figure 11:
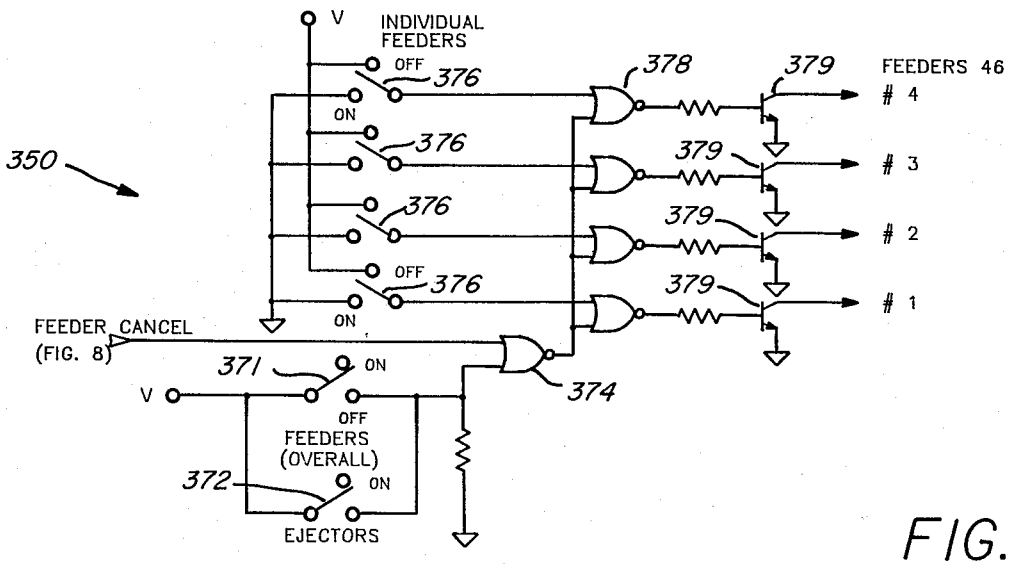

A feeder gating circuit 350 (FIG. 11) permits flow in selected ones or in all of the product streams to be periodically stopped by disabling the particular feeder or feeders 46. Closing either an overall feeder control switch 371 or an overall ejector control switch 372 causes all of the feeders 46 to be disabled, thereby stopping product flow through the sorter S. Additionally, all of the feeders are disabled during a normalization cycle, as will be set forth, under control of a FEEDER CANCEL signal. When either the FEEDER CANCEL signal is present, the feeder control switch 371 is closed or the ejector control switch 372 is closed, the output of an OR gate 374 is high, forcing a low output from each NOR gate 378, disabling a transistor 379 at the output of each gate 378, and blocking power from the feeders 46 connected thereto. Individual ones of the feeders 46 can be disabled by closing the appropriate individual feeder switch 376, in turn forcing the output of the NOR gate 378 connected to it low, disabling the appropriate feeder 46 in the manner set forth above.

Periodically, such as every three minutes or so, the sorter S goes into a normalization cycle to check the gain and bias values of each of the individual preamplifiers to verify these values are within acceptable tolerances. If they are not, appropriate adjustments are made to gain and bias of those preamplifiers which are not within tolerance. Normalizing the preamplifiers individually allows a single classification circuit for sorting all viewing stations by multiplexing the individual views on a time-share basis. A cycle control monostable multivibrator 369 (FIG. 8), preferably having a time constant equal to the interval between normalization cycles, such as three minutes, will initiate the normalization cycle when triggered. At the start of a normalization cycle, the output of multivibrator 369 goes low, a condition which is passed through an OR gate 380 to a NAND gate 382. Gate 382 forms the FEEDER CANCEL signal fed to feeder control circuit 350 (FIG. 11) to stop the feeders 46 in the manner set forth above.

Usual normalization cycles can be stopped by closing the SINGLE STEP switch 188 (FIG. 6), a condition which is sensed in gate 380 (FIG. 8) which then blocks the low output of multivibrator 369 from passing to gate 382. This feature has been included to facilitate initial adjustments of the machine.

An operator can also manually start a normalization cycle by closing a manual normalize switch 373 which fires a manual normalize monostable multivibrator 375 which clears the cycle control normalization multivibrator 369 causing the FEEDER CANCEL signal to be formed by gate 382 in the manner set forth above. The output pulse formed in the multivibrator 375 is also furnished as a reset to a normalization cycle counter 377. The normalization counter 377 is clocked by each input of the cycle control multivibrator 369. The function of counter 377 is to determine the occurrence of every fourth normalization cycle. At such times, the polarity of power to product illuminating fluorescent lamps is reversed. A gate 379 at the output of counter 377 detects every fouth normalization cycle counted, causing a $\overline{\text{LAMP REVERSE}}$ signal to be formed.

At the start of either type of normalization, unless SINGLE STEP switch 188 is closed, OR gate 380 changes state from high to low at its output as has been set forth. This triggers a time delay monostable multivibrator 384. Time delay multivibrator 384 inhibits formation of a signal by a NAND gate 398 for the duration of a delay interval set in multivibrator 384. This provides a delay interval before an EJECTOR CANCEL signal can be formed and furnished to gate 308 (FIG. 7). This allows unsatisfactory product that may be present in the viewing station V at the start of normalization to be ejected rather than fall past a prematurely disabled ejector 46.

During normalization when no lamp polarity reversal is necessary, the output from multivibrator 384 is transmitted through a closed switch 386 to a blow off solenoid timing multivibrator 388. When the delay interval of multivibrator 384 is ended, the timing multivibrator 388 is triggered to produce a time interval for energizing a transistor 389 supplying power to a blow off solenoid (not shown). This blow off solenoid is used to blow out any accumulated dust from the viewing chamber V between normalization cycles to increase accuracy of the sorter S.

If a lamp polarity reversal cycle is to occur in a normalization cycle, switch 386 is open and the output of multivibrator 384 is passed through a closed switch 39O to trigger a lamp reverse monostable multivibrator 392. The output of the lamp reverse multivibrator 392 changes the state of toggle circuit 394, which in turn changes state of a transistor pair 395 and reverses the fluorescent lamp illumination in the manner described in my prior U.S. Pat. No. 4,697,709 issued Oct. 6, 1987, to avoid unevenly darkening the fluorescent lights. This U.S. Patent is incorporated herein by reference.

Figure 12:
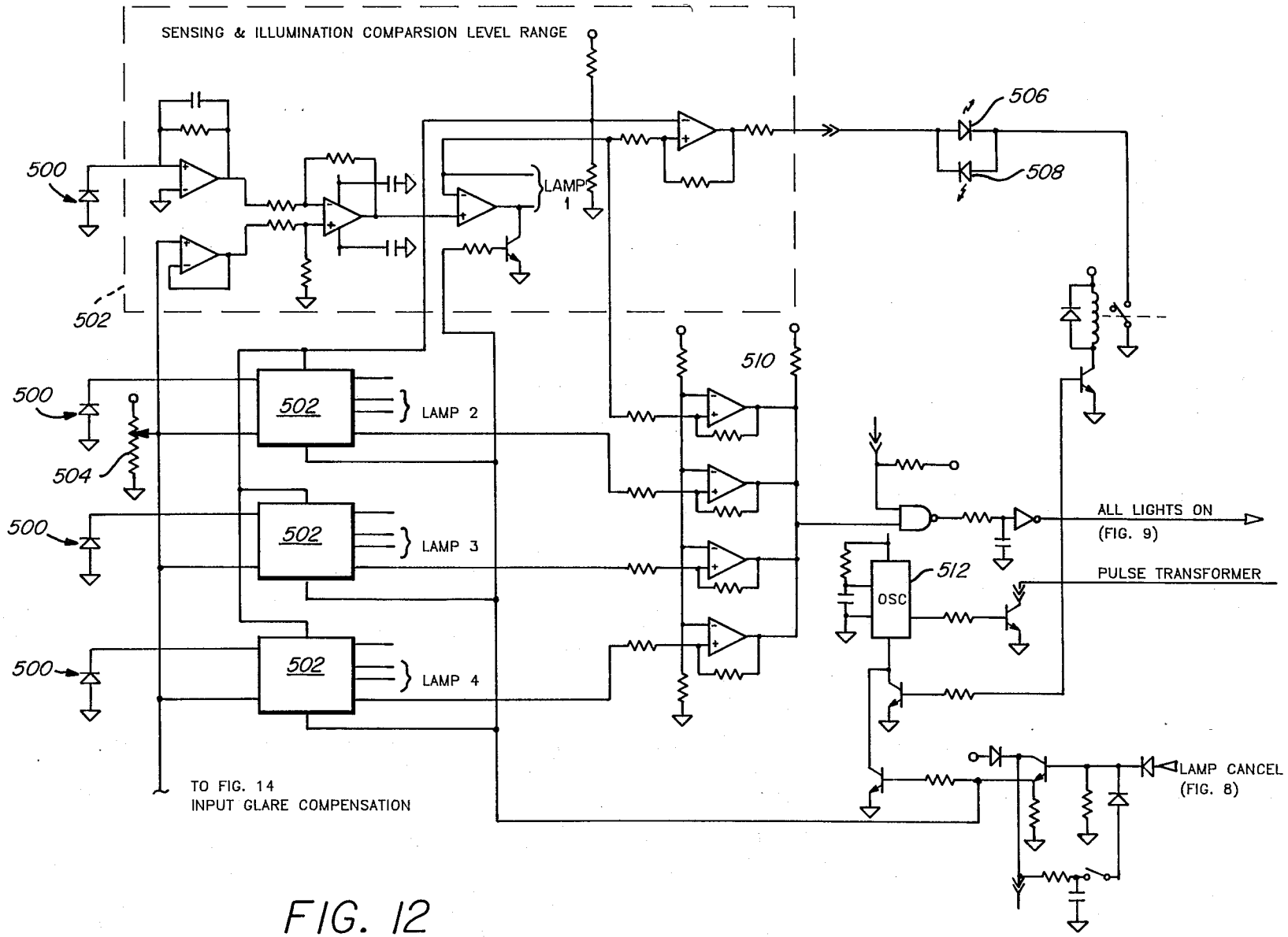

Additionally, the falling edge of the delay multivibrator 384 output triggers a lamp cancel monostable multivibrator 396 whose output causes a gate 397 to form a LAMP CANCEL signal to turn off the fluorescent lamps. When the lights are off due to the effect of the lamp cancel multivibrator 396, an ALL LIGHTS ON signal (FIGS. 8 and 12) goes low. When the fluorescent lamps are all energized and lit the ALL LIGHTS ON signal goes high, activating blow off multivibrator 388 to energize the transistor 389, driving the blow off solenoid previously discussed for the desired time interval.

A $\overline{\text{NORMALIZE}}$ signal is formed at the output of the NAND gate 398 and, when low, indicates the beginning of a normalization cycle. During the active intervals of multivibrators 388 and 396 and while one or more of the fluorescent lamps are off, the output of a three input NAND 400 is held high. This causes an input to the NAND gate 398 to be low and the $\overline{\text{NORMALIZE}}$ signal from NAND gate 398 to be high, indicating that until lamp polarity reversal is completed, the remaining control circuit 96 is not in the normalization mode. Once lamp polarity reversal is complete and all flourescent lamps on, the output of NAND gate 400 goes low. The status of gate 398 is then controlled by the other input to gate 398, which is the inverted output of OR gate 380, indicative of whether or not the sorting cycle is complete.

During the normalization cycle, the $\overline{\text{NORMALIZE}}$ signal from gate 398 is passed through a low pass filter 401 to remove any momentary transients and is inverted by an inverter 402 forming a slightly delayed NORMALIZE, or NORMALIZE.D signal. This signal is passed through a buffer 404 from which it is furnished to other portions of control circuit 96 to indicate that a normalization cycle is in process. The $\overline{\text{NORMALIZE}}$ signal from gate 398 is also furnished to a NAND gate 406. The other input to NAND gate 406 is from gate 400 inverted and is indicative that lamp polarity reversal is not being performed. The output of the NAND gate 406 is passed through a low pass filter 407 to remove any switching transients. The filtered output of gate 406 is inverted by an inverter 408 and buffered by the buffer 404. It is furnished as the $\overline{\text{EJECTOR CANCEL}}$ signal to gate 308 (FIG. 7) where it is used to inhibit actuation of ejectors 46, as previously discussed.

Figures 17, 18:
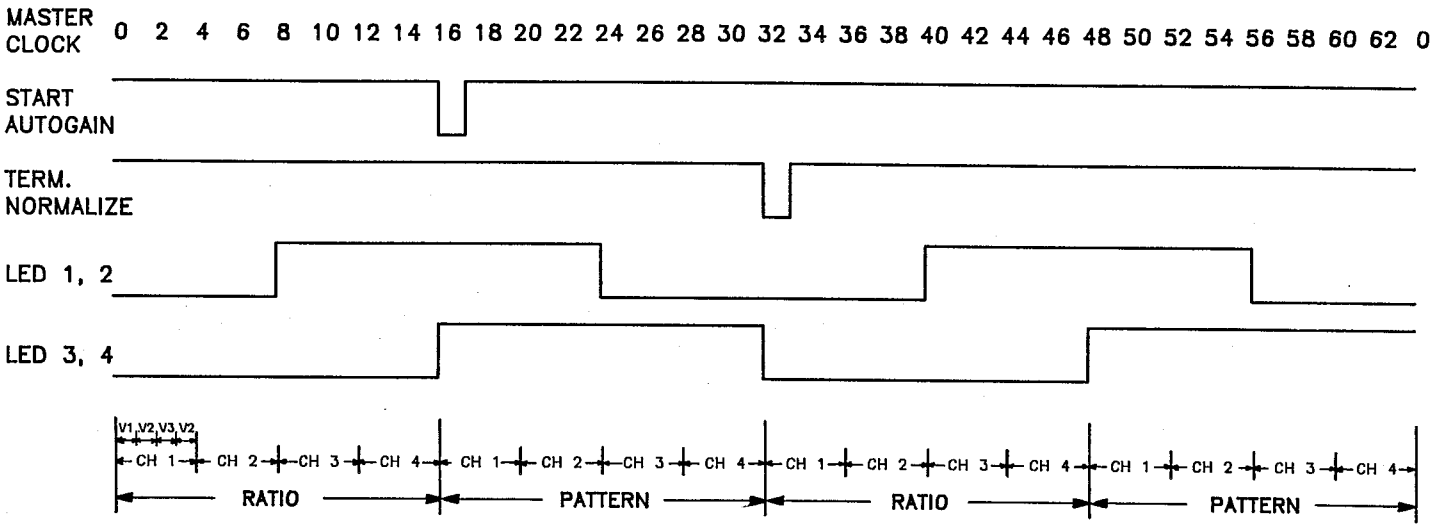
FIG. 18 is a table illustrating output signals of portions of the circuitry of FIGS. 6–15.
Figure 19:
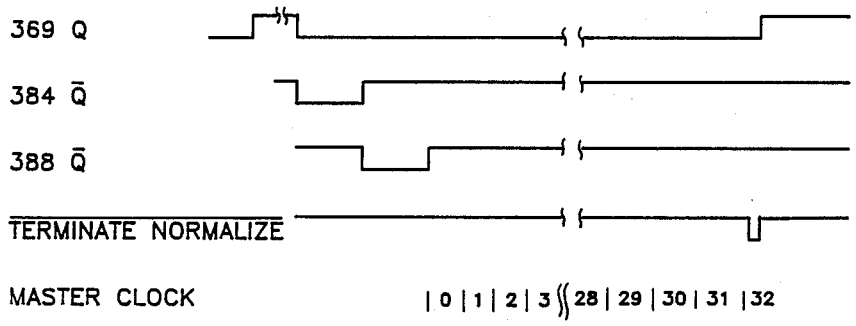
FIGS. 19 and 20 are a waveforms illustrative of the operation of the circuitry of FIGS. 6–15.
Figure 20:
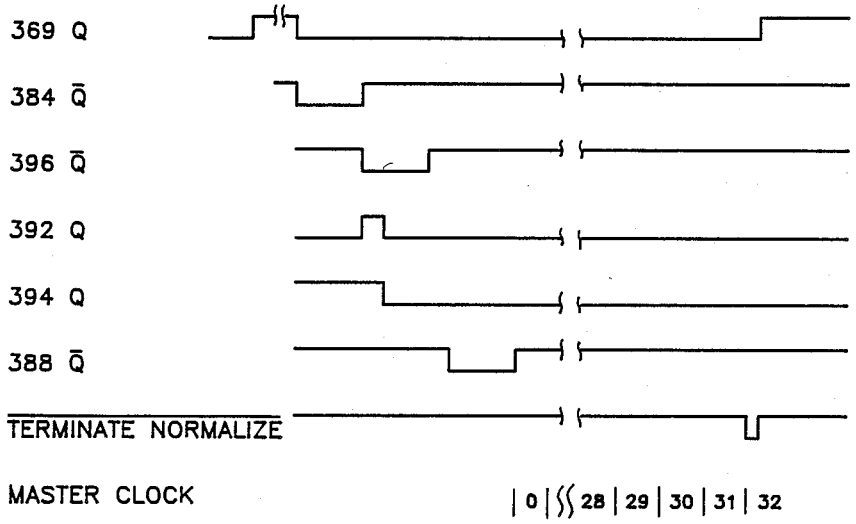

The NORMALIZE.D signal releases two NAND gates 410 and 412 when high, allowing these NAND gates 410 and 412 to pass through and invert the state of S-R flip-flop 414. The output states of NAND gates 410 and 412 during normalization represent the state of AUTO GAIN and AUTO NULL control signals (FIG. 18). These signals, after buffering by buffer 404, are used to indicate the operational status and cycle of the sorter S.

When the NORMALIZE.D signal is high during normalization, two blocking NAND gates 415 and 416 are released to allow a read only memory 370 (FIGS. 8 and 11) preferably an erasable, programmable one, to assume control, forming output signals (FIG. 18) in response to clock signals from master counter 158 (FIG. 6).

When the NORMALIZE.D signal goes high, a normalize multivibrator 418 (FIG. 8) is triggered to activate the AUTO NULL signal by setting flip-flop 414 to that state. The other output from multivibrator 418 is furnished buffer 404 from which it is provided as a signal NORMALIZE.DOS, which is used to clear the master counter 158 and the sub-interval counter 162 (FIG. 6) to begin the normalization cycle at the first photodiode pair of the first viewing station.

During the first or AUTO NULL portion of the normalization cycle, the count from master counter 158 serves as an address signal for memory 370 (FIG. 8). Memory 370 switching forms certain normalization stepping controls (FIG. 17) as master clock 158 progresses through its sequence. At count of 16 from master counter 158, adjustment of the bias level for all preamplifier/photodiode pairs in all viewing stations is accomplished. At this count, a $\overline{\text{START AUTO GAIN}}$ signal (FIG. 17) from memory 370 goes low, changing the state of R-S flip-flop 414 (FIG. 8), switching the normalization cycle to the automatic gain portion. As the normalization proceeds and completes the normalization of the automatic gain portion, the master counter 158 reaches a count 32 at which time memory 370 outputs a low level $\overline{\text{TERMINATE NORMALIZE}}$ signal (FIG. 17). This signal passes through a low pass filter 417 and activates the cycle control multivibrator 369 to begin another sorting interval. The NOR- MALIZE.D signal goes low and the NAND gates 410 and 412 return to the levels (FIG. 18) indicating product sorting operations are occurring.

At the start of each normalization cycle, a NORMALIZE.DB signal from buffer 404 (FIG. 8) goes high. In this state, the NORMALIZE.DB signal is applied to master voltage controlled oscillator 160 (FIG. 6) to slow the clock rate of the voltage controlled oscillator driving the master counter 158. This allows increased time for normalization due to the sensitivity levels being achieved during normalization. The NORMALIZE.DB signal also activates two NAND gates 172 and 174 (FIG. 6) which gate the clock signal from oscillator 160 to the master counter 158. This permits the normalization cycle to be stepped through each particular preamplifier in each viewing station during both the auto null and auto gain portions, permitting normalization to be achieved for each particular preamplifier before the counter 158 is stepped to the next preamplifier in the sequence.

At the start of the automatic null portion of the normalization cycle, the AUTO NULL signal from buffer 404 (FIG. 8) goes high, allowing buffer 140 (FIG. 9) to pass a count signal from an up/down counter pair 440 and 442 (FIG. 9) in up/down counter 136. This count signal is a value furnished as a multiplier to auto null circuit 118 to be applied to the multiplying digital-/analog converter 210 to be used in the null process.

During the automatic null portion of the normalization cycle, the output signal from amplifier 212 in auto null circuit 118 is adjusted by count signals from counter 136 until the output from amplifier 122 is detected to be within five millivolts of zero bias by up/-down control circuit 132.

Figure 15:
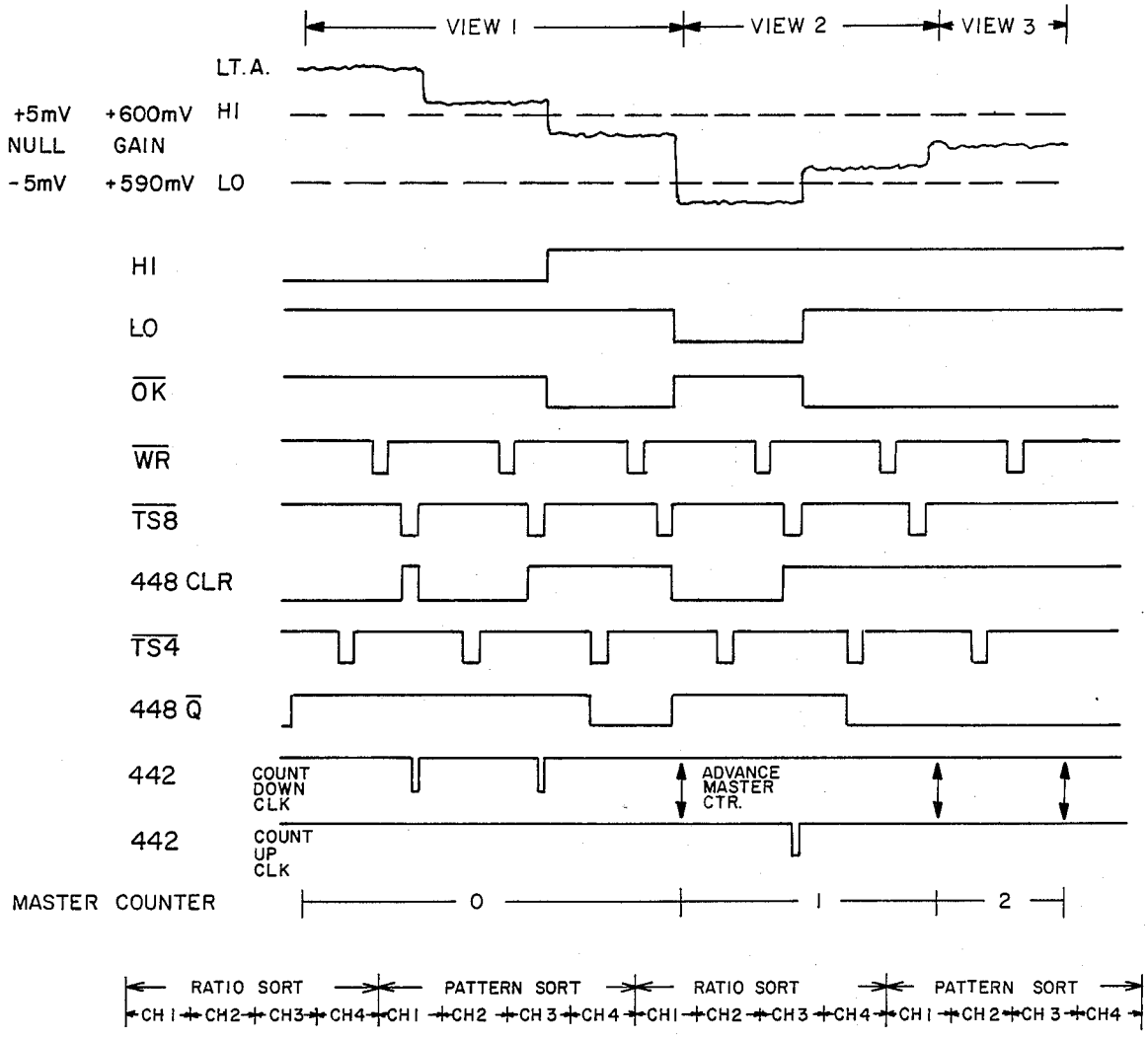
FIGS. 15, 16 and 17 are waveforms illustrative of the operation of the circuitry of FIGS. 6–15.

In auto null operation, the output from amplifier 122 is presented to the inverting input of high comparator 444 (FIG. 9) and the non-inverting input of low comparator 446. If the output of amplifier 122 is higher than the desired upper reference level limit (FIG. 15), a $\overline{HI}$ signal is formed by comparator 444, causing counter 442 to initiate a down count to decrease the offset bias being applied to amplifier 122. Down counting in this manner continues until the output of amplifier 122 is below the desired upper reference level limit. Similarly, if the output of amplifier 122 is below the desired lower reference level, counter 442 is caused to count upward by a $\overline{LO}$ signal from comparator 446 until the output of amplifier 122 is above the desired lower reference level (FIG. 15).

A gate 450 receives both the $\overline{LO}$ and $\overline{HI}$ signals and forms a $\overline{OK}$ signal (FIG. 15) when the output of amplifier 212 is within both upper and lower reference level limits.

As long as the $\overline{OK}$ signal from gate 450 is high, indicating the output of amplifier 122 is not within allowable limits, the clocking of the J-K flip-flop 448 is disabled because the clear input is held low, forcing the output 448$\overline{Q}$ high. As long as the output 448$\overline{Q}$ of flip-flop 448 is high, the NORMALIZE.DB and a D16 signal, which is the carry signal from the subinterval counter 162 (FIG. 6), are combined in a NAND gate 452 (FIG. 9) to produce an up/down counter clocking pulse, which is applied to the input gating circuitry of the up/down counter 136 to increment or decrement the count and adjust the digital signal applied to the converter 210 to adjust the bias of amplifier 212 and therefore amplifier 122.

This process continues until the bias level produces a null value which is within the desired interval. At this time, the $\overline{OK}$ signal from gate 450 goes low (FIG. 15), disabling the clear signal to flip-flop 448. This allows the $\overline{TS4}$ clocking signal, when it next occurs, to produce a low signal on output 448 $\overline{Q}$ of J-K flip-flop 448 (FIG. 9). This low level 448 $\overline{Q}$ output has two effects. First, the up-down counter 136 is locked in its present state by the application of high levels to both the count-up and count-down inputs and a low level of output 448$\overline{Q}$ is sensed by gate 174 (FIG. 6) as a count advance signal for the first color. The application of $\overline{TS8}$ as the other input to gate 451 ensures that the $\overline{Q}$ output of flip flop 448 stays low during the time that the counting pulse is applied to up down counter 442. The output of gate 450 must prove itself low from leading edge of $\overline{TS4}$ to leading edge of $\overline{TS8}$ only. This helps to avoid possible problems due to noise. Auto null for the second color of the second photodiode continues in a like manner until a low level at output $\overline{Q}$ (FIGS. 5 and 9) of the equivalent of flip-flop 448 for the second color is sensed by gate 172 as a count advance signal for the second color. Accordingly, the master counter 158 (FIG. 6) is clocked forward only when both color preamplifiers for that photodiode pair have been appropriately nulled as sensed at output of amplifier 122.

The auto null portion of the normalization cycle continues until all of color preamplifiers have completed automatic nulling. The automatic gain portion of the normalization cycle then begins.

During every interval the output of the up/down counter pair 440 and 442 (FIG. 6) is written into the appropriate memory address by an $\overline{WR6}$ signal produced by the subinterval decoder 166 (FIG. 6). This leaves the last count finally written into RAM 214. The AUTO NULL signal is applied to the $\overline{RD}$ input of the memory 214. The memories are designed such that the read enable input has priority over the write enable input, thereby allowing the write enable input to be connected to the $\overline{WR}$ signal and not requiring additional gating.

The automatic gain portion is like the auto null, except that the output of amplifier 204 in auto gain circuit 114 is furnished to up/down control circuit 132, via amplifier 122, for comparison, and the reference level furnished by automatic gain bias shift circuitry 148 is raised, changing the desired upper and lower levels reference for the high and low comparators 444 and 446. After the automatic gain portion has been completed, the normalization process is terminated by a pulse from the terminate normalization output of memory 370 (FIG. 8). This pulse triggers the multivibrator 369 and sorting operations are resumed.

Figure 10:
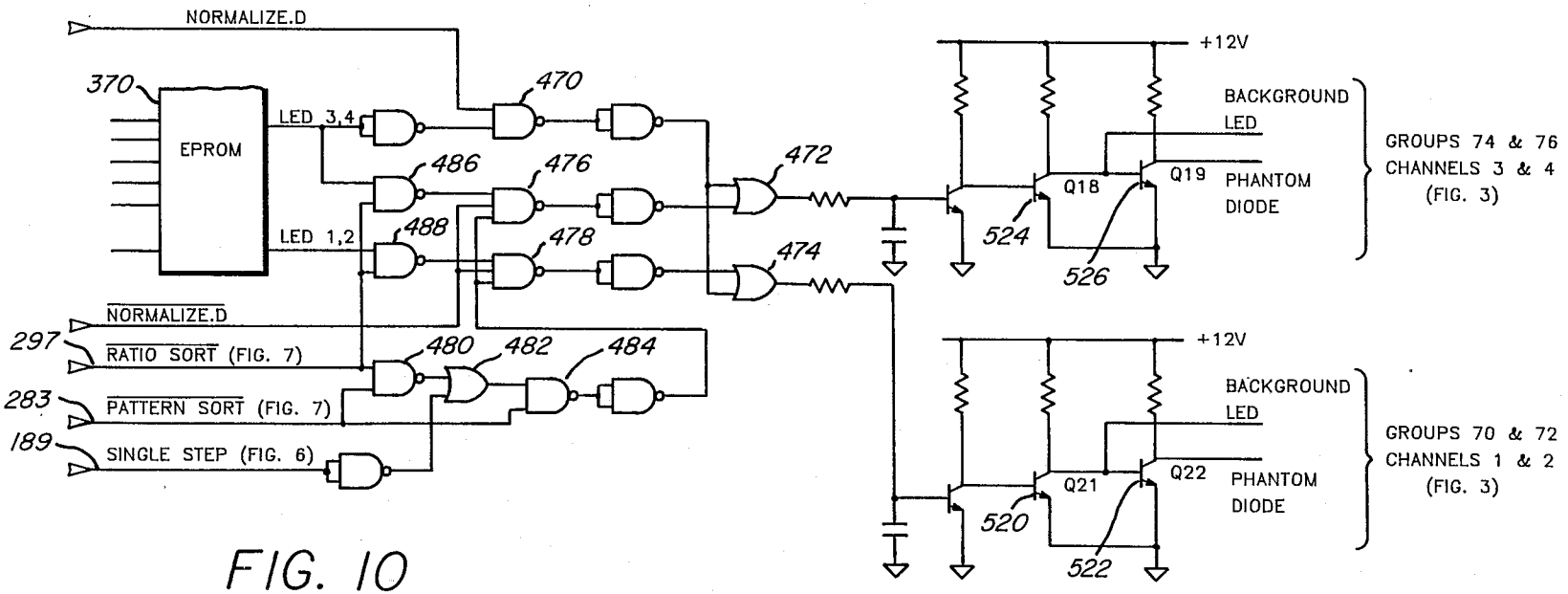

During alternate sorting, the erasable programmable read only memory 370 (FIG. 10) controls the periodic activation and deactivation of the background LED groups 70, 72, 74 and 76 (FIGS. 2, 3 and 13) which provide an active color background against which the color of product is compared. The background LEDs of 70, 72 and 74, 76 are energized in alternating groups of two sets of viewing stations during pattern check sorting. The first LED groups, 70 and 72, are in the first two viewing stations. They are energized halfway through the preceding ratio sort cycle (Count 8 of master clock 158, FIG. 17) to allow pre-amp conditions to stabilize before pattern check sorting begins (Count 16, FIG. 17). The second LED group, 74 and 76, are energized at the start of the pattern check sorting cycle (Count 16, FIG. 17) again to allow pre-amp to stabilize before pattern check sorting begins in these viewing stations. In general, no pre-amp output is sampled without waiting at least one-half of a multiplex time scan after backgrounds are turned on or off. Pre-amp time constants are compatible with this constraint. This demands two separate timing commands for L.E.D. background drive, one for backgrounds in channels 1 and 2 and one for backgrounds in channels 3 and 4. The time relation of these two signals at the output of EPROM 370 (FIG. 11) is seen in FIG. 17.

During normalization, because of the greatly reduced clock frequency, there is no problem with the finite settling time of the pre-amps and both L.E.D. groups are driven from the L.E.D. 3, 4 waveform. This is set up as follows. $\overline{\text{Normalize D}}$ is low, blocking NAND dates 476 and 478, causing these outputs to be high and the corresponding inputs to or gates 472 and 474 to be low. At the same time normalize D is high, activating gate 470 which was blocked, and passing an inverted version of the L.E.D. 3, 4 to the input of OR gates 472 and 474. For time slots 0–15 this will turn off N.P.N. transistor 524 and 520, and turn on N.P.N. transistors 526 and 522, shunting the drive currents away from the L.E.D. backgrounds and into the dummy loads, the condition reversing for time slots 16–31. This is compatible with time slots 0–15 designated for auto null and time slots 16–31 used for auto gain.

If $\overline{\text{PATTERN SORT}}$ (FIGS. 7 and 11) is low (both ratio classifiers turned off) then gates 476 and 478 have their outputs high and therefore present low inputs to both OR gates 472 and 474. The other inputs to these OR gates 472 and 474 are also low at this time because NORMALIZE.D is low This will turn on N.P.N. transistor 520 and 524 turning off transistors 522 and 526 causing the drive currents to flow into the L.E.D. backgrounds continuously.

If $\overline{\text{RATIO SORT}}$ (FIG. 7 and 10) is low (all four pattern trips off) then NAND gates 486 and 488 have their outputs high and these are transferred to the respective inputs of gates 476 and 478 (triple input NAND gates). The second input to these NAND gates is $\overline{\text{NORMALIZE}}$/ which is also high during the sorting interval. Since single step is low and $\overline{\text{PATTERN SORT}}$ is high (at least one ratio trip on) then the output of gate 484 is low, bringing the third input to gates 476 and 478 to a high state. This presents a high to both OR gates 472 and 474 which turns off transistors 524 and 520 and turns on transistors 526 and 522, shunting current away from the L.E.D. backgrounds.

If both $\overline{\text{RATIO SORT}}$ and $\overline{\text{PATTERN SORT}}$ are high (at least one pattern classifier on and at least one ratio classifier on) then gates 486 and 488 pass L.E.D. 3, 4 and L.E.D. 1, 2 signals from the EPROM 370 to the first inputs of 476 and 478. The other two inputs of 476 and 478 are high for the same reason as the $\overline{\text{RATIO SORT}}$ low case above. Since the address lines of the EPROM 370 come from the same counter chain that controls the alternation of the classifier circuits, the alternation of the backgrounds is synchronized properly.

Finally, if $\overline{\text{RATIO SORT}}$ and $\overline{\text{PATTERN SORT}}$ are both high and single step is depressed, then one input of NAND gate 484 is low, causing the outputs of gates 476 and 478 to be high. This causes the background to be on. Alternation of background is in effect meaningless in this case, since the multiplex cycle is constantly sampling one photodiode pair.

Figure 13:
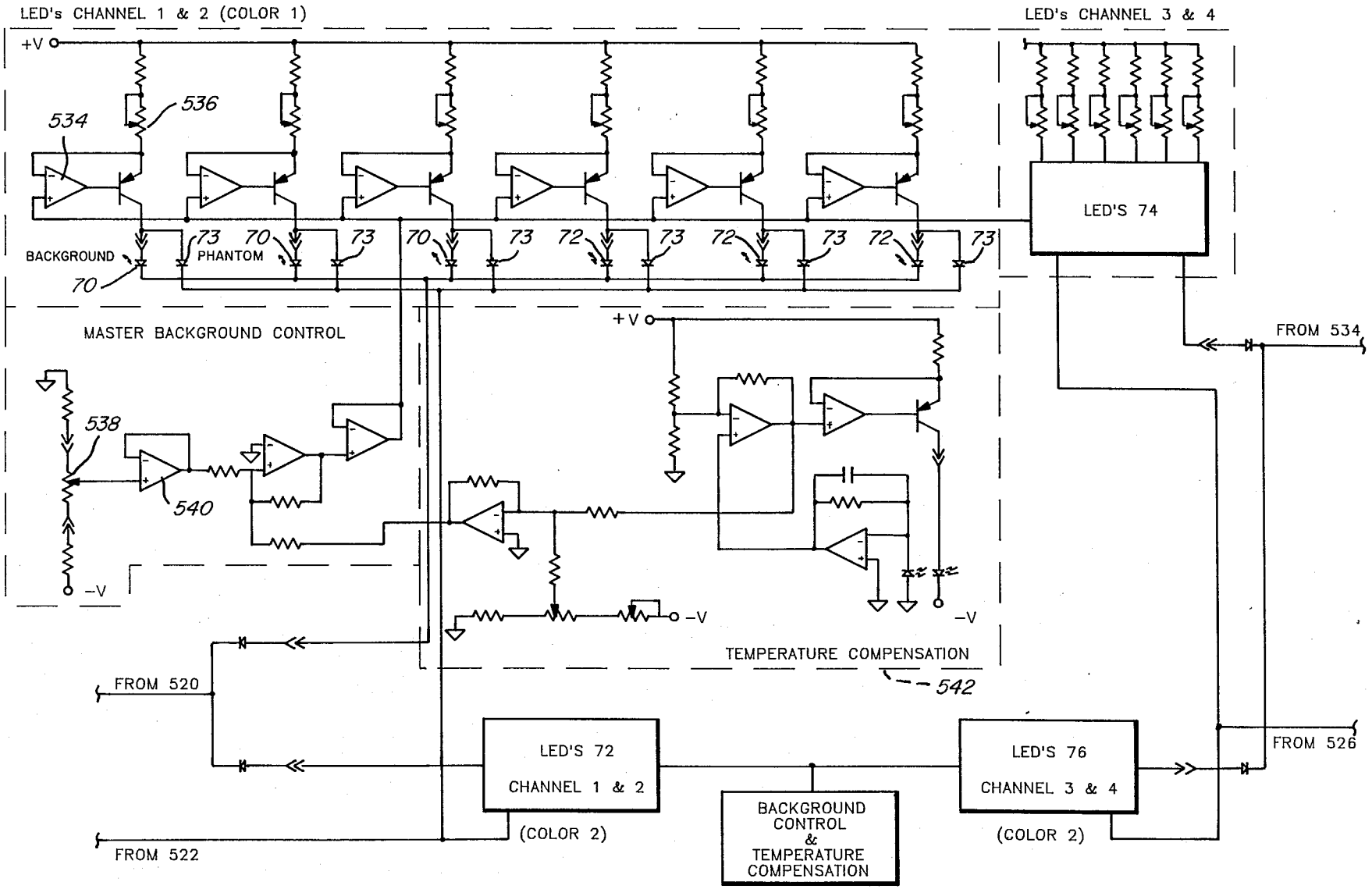

Connected in electrical parallel with each of the individual background LED's 70 and 72 is a substitute electrical load or phantom diode 73 (FIG. 13). The phantom diodes 73 provide no background illumination levels in the viewing stations, but rather serve as replacement loads for the disabled background photodiodes 70, 72, 74 and 76 to minimize electrical transients. Transistor 520 (FIG. 11) when energized passes electrical power to the background photodiodes 70 and 72 in groups 1 and 2, while disabling activation of phantom diodes 73 in such group by a transistor 522. Conversely, when transistor 522 is providing current to each phantom diode 73 in groups 1 and 2, transistor 520 is non-conductive, preventing flow of electrical power to background diodes 70 and 72 in such groups. In a like manner, transistors 524 and 526 alternate the flow of electrical power between phantom diodes 73 as one group and background LED's 74 and 76 as an alternate group.

The illumination level of light produced by each of the illuminating flourescent lamps is sensed by a photodetector 500 (FIG. 12) located near each lamp. The sensed illumination level is furnished to a comparator circuit 502 which compares the sensed level with a reference level as set by potentiometer 504, so that illumination levels can be adjusted in the manner set forth in my U.S. Pat. No. 4,697,709 issued Oct. 6, 1987, which is again hereby incorporated by reference. During these adjustments, in range or out of range indications are thus formed on LED's 506 and 508, respectively. Comparators 510 determine when an individual lamp is not illuminated. If a lamp is not properly illuminated, a low signal is produced, developing a low level ALL LIGHTS ON signal to indicate that all of the lamps are not properly activated. The LAMP CANCEL signal is used to control an oscillator 512 which drives a pulse transformer used to help start the lamps, as set forth in my prior U.S. Patent.

The background LED's 70, 72, 74, 76 and phantom diodes 73 are enabled by transistors 520, 522, 524, and 526, as has been set forth. Each of the LED's in a group is driven by an amplifier drive circuit 534 (FIG. 13). The illumination levels of the background diodes 72 are individually controlled by separate individual background control potentiometers 536 and in common by a master background control potentiometer 538. The master background control signal is buffered by an amplifier 540 and combined with a temperature compensation signal produced by a temperature compensation circuitry 542. This allows the illumination output of the background LED'S 70, 72, 74 and 76 to remain constant over varying temperatures and yet be controlled from a single source. The individual background controls 536 are provided to individually balance each diode and its drive circuit 534 and are initial set up adjustments.

Figure 14:
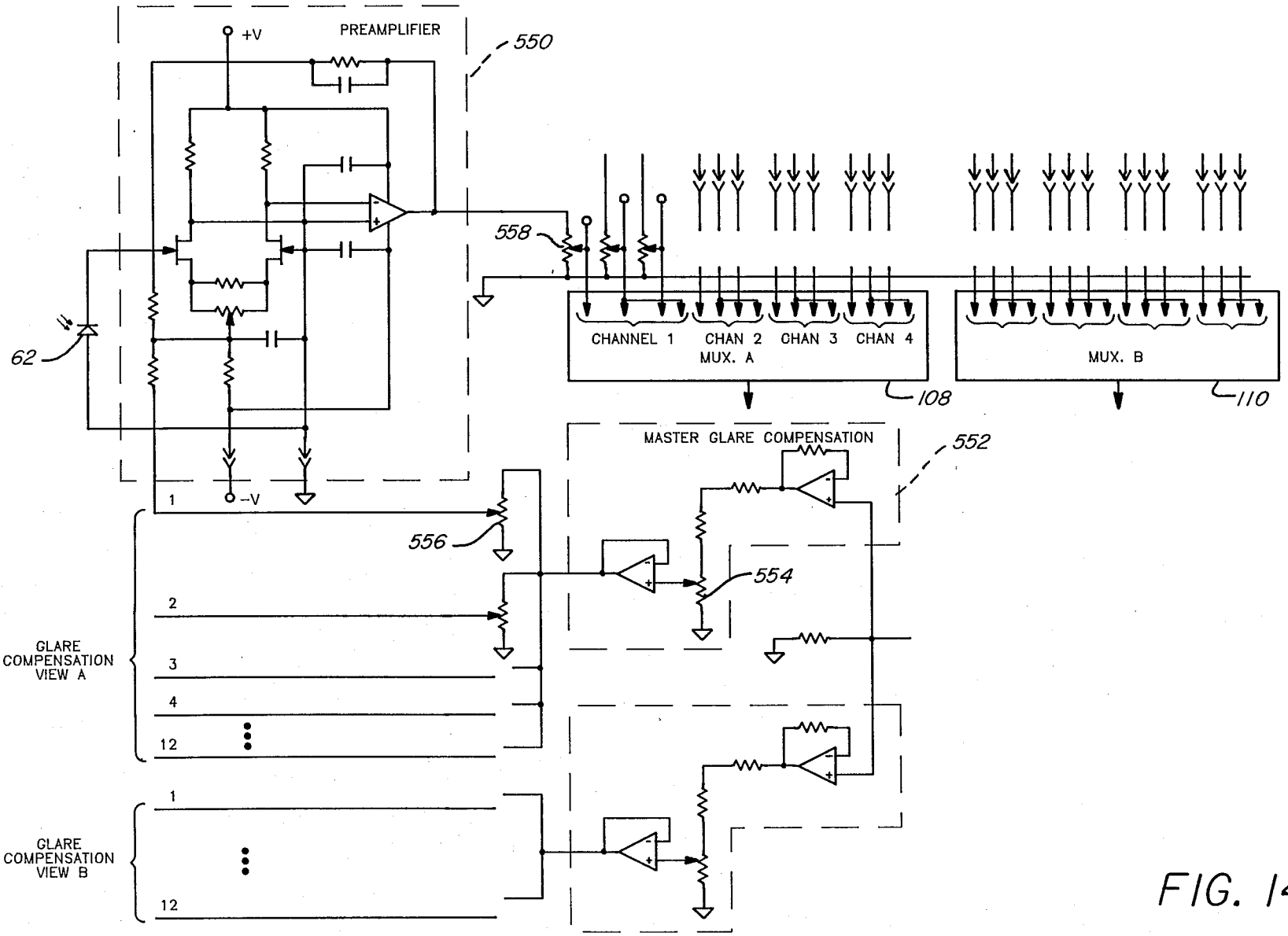

Each sensing photodiode 62 and 64 is connected to a preamplifier 550 (FIG. 14) to amplify the received photodiode signal. Overall glare compensation is set by master glare compensation circuitry 552, which includes potentiometer 554, while an individual glare compensation potentiometer 556 is separately provided for each photodiode 62 and 64, to allow each preamplifier output to be adjusted for the particular illumination level and the particular photodiode sensitivity. The potentiometers 554 and 556 are also initial set up adjustments. The output of the preamplifier 55D is connected to an individual gain control potentiometer 558 so it can be properly scaled during setup as has been previously described. Only a single photodetector 62 and preamplifier circuit 550 are shown in FIG. 15, with it being understood that the remaining circuits are of like construction and function. Note that glare compensation is made proportional to main illumination by using the arm of potentiometer 504 (FIG. 12) as master command to glare compensation circuitry.

Many previous biochromatic sorters used what is known as a pattern classifier system. In this system, the two colors of the bi-chromatic machine were considered to form an x, y coordinate system. In some quite old machines, the two color signals were actually presented in this way on a cathode ray tube (CRT) with one color signal, for example the red, causing horizontal deflection, and another, for example the green, causing vertical deflection. The color signals always moved from some reference point on the x, y system which was the point corresponding to the painted background plate, painted in such a way that when a good product was in front of the plate no signal was produced. For the machine, a good product disappeared against the background. The combination of the two color signals could pull the CRT beam in any direction from the background point, depending on the color signal strengths and polarities. Experimentally it was determined where the undesirable products would pull the beam and a pattern board was cut and mounted on the screen of the CRT in such a way that the area of the good product (and background of course) was covered up. The CRT was mounted in a dark enclosure and a light sensitive device was installed to monitor the screen of the CRT. If the light sensitive device sensed light, then the CRT beam had been moved out from under the pattern by the combination of x, y signals corresponding to a bad product, and an ejector system was activated to remove bad product.

More recent bichromatic machines might at first seem to be very different because one cannot actually see the signal processing results on a CRT screen. However, on analysis, in effect the same sorting principle is used. Thus the word "pattern" has persisted even if the pattern is determined entirely by circuitry, either analog or digital.

This technique has served quite well in many cases but suffers from inaccuracy and inconsistent results when relatively subtle color differences must be distinguished. This is due to the fact that with the "pattern" type of bi-chromatic classification, color and intensity of color cannot be clearly separated. It must be remembered that color is determined by the relative amount of the three primary colors present, not by their absolute magnitude. This concept still holds for a bichromatic color sort. This can be conceptualized by imagining a line going through the dark point (0,0) in an x, y color coordinate map. The slope of a line at any point is the ratio of y to x (or green to red colors) and therefore the line represents the locus of a given color. A short line from the origin represents a dark version of the color and a long line from the origin (at the same slope) represents a bright version of the same color.

To implement ratio sorting division of the two color component signals, one into the other, generated as the product passed in front of a dark background is performed to form a ratio of the color signals. In this case it is very important that the background be as black and glare free as possible and that the division not be performed until both component signals are of some minimal value (to avoid the inaccuracies of dividing one small quantity by the other). The output of the divider could then be fed into one input of a voltage comparator the other side of which could be connected to a variable reference representing a limit color which is unacceptable. This can be conceptualized by thinking of the color limit line through a reference point origin. If the slope of this limit line is 45° (any line more horizontal or redder than 45° would correspond to a reject, for example), a direct comparison of the horizontal signal against the vertical indicates if the color line is ever more horizontal than 45°. Changes in shading, position, and size of the product cause no problem in ratio classification since both color signal components change together under these conditions. These are the very factors which cause inaccuracies in pattern classification.

Since the ratio type of classification cannot distinguish different intensities of the same color, it is still desirable to use the pattern type of product sort or classification. However, both pattern and ratio sorting, have so far as known, not been done simultaneously, because the pattern sort demands an illuminated background and the ratio sort a completely dark background.

The sorter of the present invention overcomes this problem by turning the backgrounds on and off very rapidly in synchronization with the multiplex scanning of the entire machine. The type of classification accomplished also changes at the same frequency.

Figure 16:
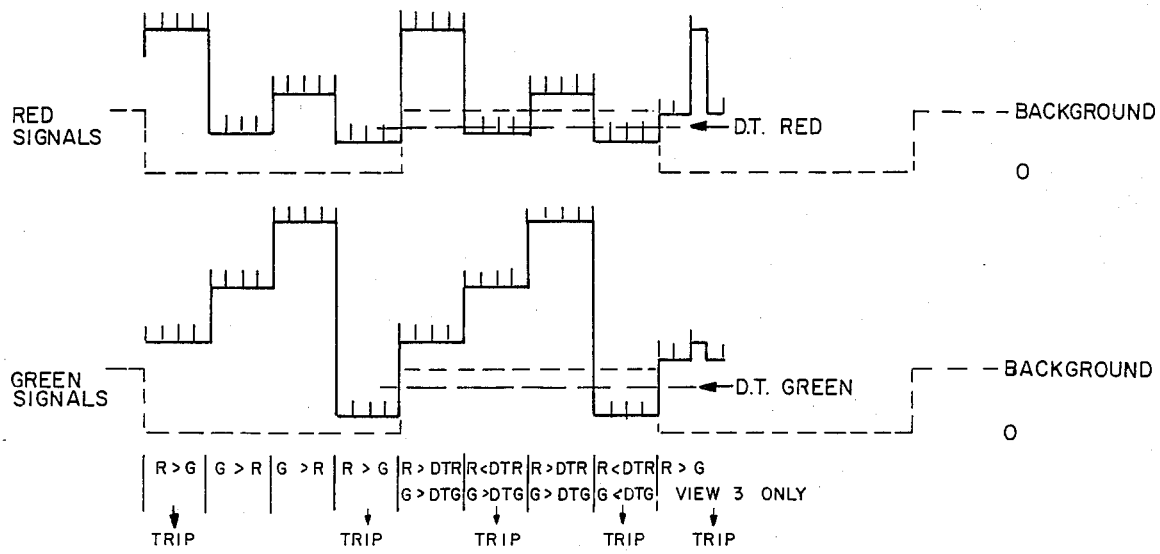

Referring to FIG. 16, example color signals (green and red) are shown for a multiplexed series of alternating ratio and pattern sorts for the four viewing channels. In FIG. 16, the first cycle of the multiplex scan is for ratio sorting for the viewing channels. In each of channels 1 and 4 of this first cycle, a red>green condition is detected. If red>green enable switch 294 (FIG. 7) is on, the unacceptable products in channel 1 and channel 4 are ejected. The second cycle of the multiplex scan is for pattern sorting. It is to be noted that the signal level excursions are around a background level, as indicated, and not from zero as in the case of the previous scan for ratio sorting. During the pattern sort cycle, the product in channel 4 is detected as indicating both DT red and DT green. The detected defective product in channel 4 is then ejected. The next cycle of the multiplex scan is once again ratio sorting. The product in channel 1 is indicated as having a reddish spot (R>G), but only in view 3. This again, however indicates an unacceptable product which is also ejected.

The foregoing disclosure and description of the invention are illustrative and explanatory thereof, and various changes in size, shape, materials, components, circuit elements, wiring connections, and contacts as well as in the details of the illustrated circuitry and construction may be made without departing from the spirit of the invention.

I claim:

1. A sorting apparatus for sorting agricultural products into acceptable and unacceptable categories based on a pattern check and a ratio check of color characteristics of the products as they descend in a chute or conduit through a zone of illumination in a viewing station, comprising:

(a) means for sensing the light reflected from successive portion of the product in the zone of illumination at plural sensors about the periphery of the zone of illumination;

(b) means for dividing the sensed light reflected from the portions of the product into plural color illumination level components;

(c) means for converting the color illumination level components into electrical component level signals;

(d) classification means for analyzing the electrical component level signals to determine if the color of individual ones of the product is acceptable, comprising:

(1) ratio check circuit means for comparing the ratio of the electrical component level signals to detect unacceptable product;

(2) pattern check circuit means for comparing each of the electrical component level signals against a reference level to detect unacceptable product;

(3) means for selectively energizing said ratio check circuit means and said pattern check circuit means;

(4) product reject means for forming a signal indicating an unacceptable product as detected by at least one of said ratio check circuit means and said pattern check circuit means;

(e) control circuit means for selectively enabling said ratio check circuit means and said pattern check circuit means;

(f) background means for providing a background illumination level in the zone of illumination when energized;

(g) means for enabling said background means when said pattern check circuit means is enabled;

(h) means for disabling said background means when said ratio check circuit means is enabled; and (i) ejector means responsive to said product reject means for removing unacceptable product from the descending products.

2. The apparatus of claim 1, wherein said control circuit means comprises:

means for sequentially enabling said ratio check circuit means and said pattern check circuit means in alternation with each other.

3. The apparatus of claim 1, wherein said control circuit means comprises:

means for sequentially enabling said ratio check circuit means and said pattern check circuit means in alternation with each other at a rate so that light from substantially the same portion of the descending product is presented to said both said pattern check circuit and said ratio check circuit.

4. The apparatus of claim 1, wherein the apparatus has plural product chutes, each having a viewing station therewith.

5. The apparatus of claim 4, further including:

multiplexer means for presenting the component level signals from the plural sensors of each viewing station to said classification means in a timed sequence.

6. The apparatus of claim 4, further including:

multiplexer means for presenting the component level signals separately for each color from the plural sensors of each viewing station to said classification means in a timed sequence.

7. The apparatus of claim 1, further including:

multiplexer means for presenting the component level signals separately for each color from the plural sensors to said classification means in a timed sequence.

8. The apparatus of claim 1, further including:

background power supply means for providing power to said background means in response to said means for enabling.

9. The apparatus of claim 8, further including:

a substitute electrical load for said power supply means, and wherein:

said control circuit means comprises means connecting said substitute electrical load to said background power supply means when said ratio check means is enabled.

10. The apparatus of claim 1, further including:

multiplexer means for presenting the component level signals from the plural sensors to said classification means in a timed sequence.

11. The apparatus of claim 1, wherein the descent of product is periodically interrupted, and wherein:

said means for sensing further comprises means for sensing reference light conditions in the viewing station in the absence of product.

12. The apparatus of claim 11, further including:

means forming a common reference gain level for the electrical component level signals.

13. The apparatus of claim 12, further including:

(a) means for comparing the sensed reference light conditions with the common reference gain level;

(b) gain control means for controlling the gain level of the electrical component level signals; and (c) means responsive to said means for comparing for adjusting the gain of said gain control means.

14. The apparatus of claim 13, further including:

means responsive to said means for adjusting for storing the adjusted gain of said gain control means.

15. The apparatus of claim 11, further including:

means forming a common reference null level for the electrical component level signals.

16. The apparatus of claim 15, further including:

(a) means for comparing the sensed reference light conditions with the common reference null level;

(b) null control means for controlling the null level of the electrical component level signals; and (c) means responsive to said means for comparing for adjusting the null of said null control means.

17. The apparatus of claim 16, further including:

means responsive to said means for adjusting for storing the adjusted null level of said null level control means.

18. The apparatus of claim 11, further including:

means forming a common reference gain level for the electrical component level signals; and means forming a common reference null level for the electrical component level signals.

19. The apparatus of claim 18, further including:

(a) means for comparing the sensed reference light condition with the common reference gain and null levels;

(b) gain control means for controlling the gain level of the electrical component levels signals;

(c) means responsive to said means for comparing for adjusting the gain of said gain control means;

(d) null control means for controlling the null level of the electrical component level signals; and (e) means responsive to said means for comparing for adjusting the null of said null control means.

20. The apparatus of claim 19, wherein the apparatus has plural product chutes, each having a viewing station therewith.

21. The apparatus of claim 20, further including:

multiplexer means for presenting the sensed reference light conditions from the plural sensors to said means for comparing in a timed sequence.

22. The apparatus of claim 19, further including:

means responsive to said means for adjusting for storing the adjusted gain and null level of said gain and null level control means.

* * * * *